US006340664B1

(12) United States Patent
Gassenmeier et al.

(10) Patent No.: US 6,340,664 B1
(45) Date of Patent: Jan. 22, 2002

(54) LAUNDRY DETERGENT OR CLEANING PRODUCT TABLETS WITH PARTIAL COATING

(75) Inventors: Thomas Gassenmeier, Duesseldorf; Fred Schambil, Monheim; Juergen Millhoff, Duesseldorf, all of (DE)

(73) Assignee: Henkel Kommanditgesellschaft auf Aktien (KGaA), Duesseldorf (DE)

( * ) Notice: Subject to any disclaimer, the term of this patent is extended or adjusted under 35 U.S.C. 154(b) by 0 days.

(21) Appl. No.: 09/648,163

(22) Filed: Aug. 25, 2000

(30) Foreign Application Priority Data

Aug. 26, 1999 (DE) ..... 199 40 547

(51) Int. Cl.[7] ..... C11D 17/00; C11D 3/37

(52) U.S. Cl. ..... 510/441; 510/224; 510/294; 510/298; 510/446; 510/475; 510/476

(58) Field of Search ..... 510/294, 298, 510/224, 441, 475, 446, 476

(56) References Cited

U.S. PATENT DOCUMENTS

| | | | | |
|---|---|---|---|---|
| 3,234,258 A | | 2/1966 | Morris | |
| 3,836,537 A | | 9/1974 | Boerwinkle et al. | |
| 4,237,253 A | | 12/1980 | Jacquet et al. | |
| 4,324,780 A | | 4/1982 | Jacquet et al. | |
| 4,664,839 A | | 5/1987 | Rieck | |
| 4,814,101 A | | 3/1989 | Schieferstein et al. | |
| 4,820,439 A | | 4/1989 | Rieck | |
| 4,985,553 A | | 1/1991 | Fuertes et al. | |
| 5,075,041 A | | 12/1991 | Lutz | |
| 5,356,607 A | | 10/1994 | Just | |
| 5,407,598 A | * | 4/1995 | Olson et al. | 252/186.35 |
| 5,417,951 A | | 5/1995 | Just | |
| 5,494,488 A | | 2/1996 | Arnoldi et al. | |
| 5,501,814 A | | 3/1996 | Engelskirchen et al. | |
| 5,541,316 A | | 7/1996 | Engelskirchen et al. | |
| 5,780,420 A | | 7/1998 | Breuer et al. | |
| 5,783,541 A | * | 7/1998 | Tack et al. | 510/224 |
| 5,821,360 A | | 10/1998 | Engelskirchen et al. | |
| 5,959,101 A | | 9/1999 | Engelskirchen et al. | |
| 6,007,735 A | * | 12/1999 | Creed | 252/186.25 |

FOREIGN PATENT DOCUMENTS

| | | |
|---|---|---|
| DE | 2 150 557 | 6/1972 |
| DE | 28 17 369 | 10/1978 |
| DE | 37 08 451 | 10/1988 |
| DE | 39 29 973 | 3/1991 |
| DE | 43 03 320 | 8/1994 |
| DE | 44 00 024 | 7/1995 |
| DE | 44 17 734 | 11/1995 |
| DE | 195 40 086 | 4/1997 |
| DE | 196 00 018 | 7/1997 |
| DE | 197 09 991 | 9/1998 |
| DE | 197 10 254 | 9/1998 |
| DE | 199 20 118 | 11/2000 |
| EP | 0 055 100 | 6/1982 |
| EP | 0 164 514 | 12/1985 |
| EP | 0 232 202 | 8/1987 |
| EP | 0 427 349 | 5/1991 |
| EP | 0 472 042 | 2/1992 |
| EP | 0 542 496 | 5/1993 |
| EP | 0 716 144 | 6/1996 |
| EP | 0 846 754 | 6/1998 |
| EP | 0 846 755 | 6/1998 |
| EP | 0 846 756 | 6/1998 |
| JP | 58-217598 | 12/1983 |
| WO | WO 90/13533 | 11/1990 |
| WO | WO 91/08171 | 6/1991 |
| WO | WO 92/18542 | 10/1992 |
| WO | WO 93/08251 | 4/1993 |
| WO | WO 93/16110 | 8/1993 |
| WO | WO 94/28030 | 12/1994 |
| WO | WO 95/07303 | 3/1995 |
| WO | WO 95/07331 | 3/1995 |
| WO | WO 95/12619 | 5/1995 |
| WO | WO 95/20029 | 7/1995 |
| WO | WO 95/20608 | 8/1995 |
| WO | WO 98/40463 | 9/1998 |

OTHER PUBLICATIONS

Römpp Chemie Lexikon 9th ed., vol. 6, p. 4440 (1992) (English translation).

Lehrbuch der pharmazeutischen Technologie, 6 (1987) pp. 182–184 (English translation).

* cited by examiner

*Primary Examiner*—Lorna M. Douyon
(74) *Attorney, Agent, or Firm*—Wayne X. Jaeschke; Glenn E. J. Murphy

(57) ABSTRACT

Partially coated laundry detergent and cleaning product tablets having advantageous properties such as high hardnesses without adverse effect on short disintegration times and high resistance to edge fracture are achieved with relatively small amounts of coating agents if the coating covers only mechanically sensitive parts of the tablets.

20 Claims, No Drawings

LAUNDRY DETERGENT OR CLEANING PRODUCT TABLETS WITH PARTIAL COATING

The present invention is situated within the field of compact tablets having detersive properties. Laundry detergent and cleaning product tablets of this kind include, for example, tablets for the washing of textiles, machine dishwashing detergent tablets or hard surface cleaning product tablets, bleach tablets for use in washing machines or dishwashers, water softener tablets, and scouring salt tablets. The invention relates in particular to laundry detergent and cleaning product tablets which are used for washing textiles in a domestic washing machine, and are referred to for short as detergent tablets.

Detergent tablets have been widely described in the prior art and are enjoying increasing popularity among users owing to the ease of dosing. Tableted detergents have a number of advantages over their powder-form counterparts: they are easier to dose and to handle, and have storage and transport advantages owing to their compact structure. Consequently, laundry detergent and cleaning product tablets have been described comprehensively in the patent literature as well. One problem which occurs again and again in connection with the use of detersive tablets is the inadequate disintegration and dissolution rate of the tablets under application conditions. Since tablets of sufficient stability, i.e., dimensional stability and fracture resistance, can be produced only by means of relatively high compressive pressures, there is severe compaction of the tablet constituents and, consequently, retarded disintegration of the tablet in the aqueous liquor, leading to excessively slow release of the active substances in the washing or cleaning operation. Another problem which occurs in particular with laundry detergent and cleaning product tablets is the friability of the tablets, or their often inadequate stability to abrasion and edge fracture. Thus, although it is possible to produce sufficiently fracture-stable, i.e., hard laundry detergent and cleaning product tablets, these tablets are often not up to the loads involved in packaging, transit and handling, i.e., falling stresses and frictional stresses, with the result that edge-fracture and abrasion phenomena may impair the appearance of the tablet or may even lead to complete destruction of the tablet structure.

To overcome the dichotomy between hardness, i.e., transport and handling stability, and the ready disintegration of the tablets, numerous approaches to solutions have been developed in the prior art. One approach, which is known in particular from the field of pharmacy and has expanded into the field of laundry detergent and cleaning product tablets, is the incorporation of certain disintegration aids, which facilitate the ingress of water or which, on ingress of water, swell, evolve gas, or exert a disintegrating effect in another form. Other proposed solutions from the patent literature describe the compression of premixes of defined particle sizes, the separation of certain ingredients from certain other ingredients, and the coating of individual ingredients, or of the whole tablet, with binders.

The coating of laundry detergent and cleaning product tablets is subject-matter of a number of patent applications.

For instance, European Patent Applications EP 846 754, EP 846 755 and EP 846 756 (Procter & Gamble) describe coated laundry detergent tablets comprising a "core" comprising compacted particulate laundry detergent and cleaning product, and a "coating", the coating materials used comprising dicarboxylic acids, especially adipic acid, which if desired comprise further ingredients, examples being disintegration aids.

Coated laundry detergent tablets are also subject-matter of European Patent Application EP 716 144 (Unilever). According to the details in that document, the hardness of the tablets may be intensified by means of a "coating" without detracting from the disintegration and dissolution times. Coating agents specified are film-forming substances, especially copolymers of acrylic acid and maleic acid, or sugars.

The prior German patent application DE 199 20 118.8 (Henkel) describes laundry detergent or cleaning product tablets coated with certain polymers or polymer mixtures, said coating materials producing thin and yet stable coats which enhance the physical properties of the tablets.

Details on the application of the coating are sparse in all of the abovementioned documents. Likewise, the majority of documents fail to specify the thickness of the coat. A further feature common to all documents is that in each case the whole tablet is provided with the coating. A consequence of this is that the dissolution or disintegration of the tablets can only ensue once the application liquor has at least partly dissolved or eroded the coating. In other words, the majority of coating agents lead to retarded disintegration, which is a problem especially when the disintegration of the tablet is intended to be brought about by means of cocompressed disintegration aids which need to come into contact with water as quickly as possible in order to develop their activity.

It is an object of the present invention to provide coated laundry detergent and cleaning product tablets with which the advantageous properties of the higher hardnesses are achievable with smaller quantities of coating agents, without detracting from the short disintegration times. In particular, the aim was to improve further the resistance of the tablets to falling and frictional loads, as compared with the known tablets, despite the markedly reduced level of use of coating materials. In this context, improving the edge-fracture stability is particularly important, since edge-fracture phenomena are perceived by the user as being a significant defect. A further object of the present invention is to provide a process for producing such coated tablets which is easy to carry out and universally applicable.

It has now been found that the abrasion stability and edge-fracture resistance of laundry detergent or cleaning product tablets may be improved without the abovementioned disadvantages by applying to the tablets a partial coating which covers only the mechanically sensitive parts of the tablets.

The invention accordingly provides laundry detergent or cleaning product tablets comprising compacted particulate laundry detergent or cleaning product and comprising builder(s), surfactant(s) and, if desired, further laundry detergent or cleaning product constituents, wherein the tablets have a coating which covers only mechanically sensitive parts of the tablet.

The term "mechanically sensitive parts" refers to those regions of the tablet that are particularly susceptible to mechanical loads. Specifically, it relates to corners and edges of the tablets, although narrow connecting pieces which, for example, delimit cavities in the tablet are included among the mechanically sensitive parts of tablets. In the latter case, the edges in question are so close to one another that the area between the edges is also covered by the coating applied in accordance with the invention. Larger planar faces such as, for example, the two circular faces of cylindrical tablets are mechanically sensitive only at the marginal regions, i.e., again at the edges, but not on the face.

If the tablets have raised or depressed areas (for example, embossed letters or geometrical structures protruding from the faces, such as hemispheres, etc.), then their marginal regions are likewise mechanically sensitive. Only a spherical tablet has no mechanically sensitive parts and is therefore not subject-matter of the present invention. If, however, there is deviation from the ideal spherical form and, for example, a biconvex tablet is provided, then this tablet is again mechanically sensitive at the annular line delimiting the two spherical sections.

The partial coating of the laundry detergent or cleaning product tablets of the invention serves to protect the mechanically sensitive regions of the tablets against excessive loads and against the attendant negative phenomena such as edge fracture, for example. In this context it is preferred to make the surface of the tablets of the invention that is not covered by the coating as large as possible. Preference is given here to laundry detergent or cleaning product tablets wherein the coating covers not more than 80%, preferably not more than 65%, and in particular not more than 50%, of the total surface area of the tablet.

Depending on the geometry of the laundry detergent or cleaning product tablets of the invention, preferred values for the surface area covered with the partial coating are even lower, for example, below 45%, preferably below 40% and in particular below 35%. The last-mentioned values may be realized, for example, in the case of tablets having only a few sensitive regions, for example, the abovementioned biconvex tablets. In the case of complex geometrical forms, examples being octagonal tablets having embossing on top and bottom, there is of course a greater number of sensitive regions, so that the area covered with a coating in the case of such complex tablets is greater.

The tablets of the invention may take on any geometric form whatsoever, particular preference being given to concave, convex, biconcave, biconvex, cubic, tetragonal, orthorhombic, cylindrical, spherical, cylinder-segmentlike, discoid, tetrahedral, dodecahedral, octahedral, conical, pyrimidal, ellipsoid, pentagonal-, heptagonal- and octagonal-prismatic, and rhombohedral forms. It is also possible to realize completely irregular outlines, such as arrow or animal forms, trees, clouds, etc. If the tablets of the invention have corners and edges, these are preferably rounded off. As additional visual differentiation, an embodiment having rounded corners and beveled (chamfered) edges is preferred.

In the case of the two last-mentioned designs of the tablet edges, as well, these edges are still mechanically sensitive. In the case of the beveled edges, a generally right angle is merely replaced by two angles connected to one another by a small face. Even rounded edges which do not run to a point are still sufficiently sensitive to edge fracture that the design according to the invention brings distinct advantages.

In general, in the context of the present invention, preference is given to laundry detergent or cleaning product tablets where the coating is applied to the corners and/or edges of the tablets.

When the distances between two edges are small, the technical expense required for applying separate edge coatings goes up. In these cases, a coating may be applied which includes the face from edge to edge. In the case of tablet in the shape of a cylindrical disc, the coating then has the form of a ring which covers the outer face of the cylinder and on the two circular faces covers only the outer region. With larger edge spacings, for example, at distances of more than 10 mm, preferably more than 15 mm, and in particular more than 20 mm, it is preferred no longer to provide the entire face between the edges with coating but instead to apply a separate marginal coating to each edge.

For edge distances of this kind, preference is given to laundry detergent or cleaning product tablets wherein the coating covers from 1 to 60%, preferably from 5 to 50%, and in particular from 10 to 40%, of the distance between two edges.

In addition to the increase in stability without adverse effect on disintegration time, a further advantage of the laundry detergent or cleaning product tablets of the invention is that only small quantities of coating materials are required. By this means it is possible to provide maximum mechanical protection with minimal use of material. Irrespective of the nature and composition of the coating, preferred laundry detergent or cleaning product tablets of the invention are those wherein the weight ratio of uncoated tablet to coating is greater than 10 to 1, preferably greater than 50 to 1, and in particular greater than 100 to 1.

The thickness of the coating varies depending on the composition of the coating and on the nature of the substances used as coating materials. Certain film-forming polymers may bring about mechanical protection with considerably lower coat thicknesses than, for example, coating materials such as solidified salt melts, etc. Independently of the abovementioned parameters, preference is given to laundry detergent or cleaning product tablets of the invention wherein the thickness of the coating is from 0.1 to 3000 $\mu$m, preferably from 0.5 to 500 $\mu$m, and in particular from 5 to 250 $\mu$m.

After the general indications relating to the coating, there now follow more specific indications relating to individual coating materials which may be used with preference as the partial coating in the context of the present invention.

In the context of the present invention, numerous materials are suitable ingredients of the coating. They originate, for example, from the groups of the inorganic salts, organic water-soluble compounds, polymers, carbohydrates, or laundry detergent or cleaning product ingredients, this list being by no means complete. Particularly preferred materials for the partial coating are described hereinbelow.

For example, preference is given to laundry detergent or cleaning product tablets wherein the coating comprises one or more solid substances having a solubility in water of more than 200 g/l at 20° C.

The partial coating applied in accordance with the invention to the tablets may consist entirely of said solid substances having a solubility in water of more than 200 g/l at 20° C., although it may of course include further ingredients. Said coating materials possess per se solubilities of more than 200 grams of solubilizer in one liter of deionized water which is at 20° C.

Suitable such coating materials in the context of the present invention include a wide range of compounds, which may originate either from the group of the covalent compounds or from the group of the salts. As already mentioned, it is preferred if the coating materials have even higher solubilities. An overview of the solubilities of partial coating ingredients that are suitable in the context of the present invention is given in the list below. The solubility values specified in this table relate—unless other temperatures are explicitly cited—to the solubility at 20° C.

| | |
|---|---|
| Sodium carbonate monohydrate | 210 g/l |
| Sodium carbonate decahydrate | 210 g/l |
| Lactose monohydrate (25° C.) | 216 g/l |
| Disodium hydrogen phosphate dodecahydrate | 218 g/l |
| Potassium dihydrogen phosphate | 222 g/l |

-continued

| | |
|---|---|
| Potassium hydrogen carbonate | 224 g/l |
| Sodium dithionite | 224 g/l |
| Disodium fumarate (25° C.) | 228 g/l |
| Calcium levulinate | 250 g/l |
| Glycine (25° C.) | 250 g/l |
| Potassium monopersulfate | 256 g/l |
| Trisodium phosphate dodecahydrate | 258 g/l |
| Ammonium iron(II) sulfate hexahydrate | 269 g/l |
| Magnesium sulfate | 269 g/l |
| Potassium hexacyanoferrate(II) trihydrate (12° C.) | 270 g/l |
| Disodium tartrate dihydrate | 290 g/l |
| Calcium acetate hydrate | 300 g/l |
| Potassium hexacyanoferrate(III) | 315 g/l |
| Potassium nitrate | 320 g/l |
| Manganese(II) acetate tetrahydrate | 330 g/l |
| L(+)-ascorbic acid | 333 g/l |
| Potassium chloride | 340 g/l |
| Lithium sulfate monohydrate | 340 g/l |
| Zinc sulfate monohydrate | 350 g/l |
| Dipotassium oxalate monohydrate | 360 g/l |
| Sodium chloride | 360 g/l |
| L-(−)-malic acid | 363 g/l |
| Sodium bromate | 364 g/l |
| Ammonium chloride | 370 g/l |
| Ammonium dihydrogen phoshate | 370 g/l |
| Iron(II) sulfate heptahydrate | 400 g/l |
| Sodium azide (17° C.) | 417 g/l |
| L-Lysine monohydrochloride | 420 g/l |
| Magnesium nitrate hexahydrate | 420 g/l |
| Zinc acetate dihydrate | 430 g/l |
| Potassium hydrogen sulfate | 490 g/l |
| Sodium acetate | 490 g/l |
| Sodium sulfite (40° C.) | 495 g/l |
| Magnesium perchlorate hydrate (25° C.) | 500 g/l |
| Lithium nitrate | 522 g/l |
| β-Alanine (25° C.) | 545 g/l |
| L-(−)-sorbose (17° C.) | 550 g/l |
| Sodium peroxodisulfate | 556 g/l |
| Sodium thiocyanate | 570 g/l |
| Ammonium peroxodisulfate | 582 g/l |
| Sodium glutamate (25° C.) | 590 g/l |
| Ammonium bromide | 598 g/l |
| Aluminum sulfate 18-hydrate | 600 g/l |
| Aluminum sulfate hydrate (16–18 $H_2O$) | 600 g/l |
| Potassium sodium tartrate tetrahydrate | 630 g/l |
| Potassium bromide | 650 g/l |
| Sodium hydrogen sulfate monohydrate | 670 g/l |
| D-(+)-Galactose (25° C.) | 680 g/l |
| Sodium thiosulfate pentahydrate | 680 g/l |
| Diammonium hydrogen phosphate | 690 g/l |
| Magnesium sulfate heptahydrate | 710 g/l |
| Calcium chloride | 740 g/l |
| Trilithium citrate tetrahydrate (25° C.) | 745 g/l |
| Ammonium sulfate | 760 g/l |
| Manganese(II) sulfate monohydrate | 762 g/l |
| Maleic acid (25° C.) | 788 g/l |
| Ammonium carbamate | 790 g/l |
| Sodium bromide | 790 g/l |
| D-(+)-Glucose monohydrate (25° C.) | 820 g/l |
| Lithium chloride | 820 g/l |
| Sodium formate | 820 g/l |
| Sodium saccharin hydrate | 830 g/l |
| Sodium nitrate | 880 g/l |
| Tripotassium phosphate heptahydrate | 900 g/l |
| Sodium sulfate decahydrate | 900 g/l |
| Iron(III) chloride | 920 g/l |
| Iron(III) chloride hexahydrate | 920 g/l |
| Trisodium citrate 5.5-hydrate (25° C.) | 920 g/l |
| Zinc sulfate heptahydrate | 960 g/l |
| Ammonium carbonate | 1000 g/l |
| Calcium chloride dihydrate | 1000 g/l |
| Sodium chlorate | 1000 g/l |
| Sodium polyphosphate | 1000 g/l |
| Sodium salicylate | 1000 g/l |
| Resorcinol | 1000 g/l |
| Urea | 1080 g/l |
| Sodium hydroxide | 1090 g/l |
| Sodium dihydrogen phosphate monohydrate | 1103 g/l |

-continued

| | |
|---|---|
| Potassium hydroxide | 1120 g/l |
| Ammonium nitrate | 1183 g/l |
| Sodium acetate trihydrate | 1190 g/l |
| Ammonium iron(III) citrate | 1200 g/l |
| Manganese(II) chloride dihydrate | 1200 g/l |
| Ammonium iron(III) sulfate dodecahydrate (25° C.) | 1240 g/l |
| Potassium iodide | 1270 g/l |
| Malonic acid | 1390 g/l |
| Manganese (II) chloride | 1400 g/l |
| DL-Malic acid (26° C.) | 1440 g/l |
| Ammonium acetate | 1480 g/l |
| Iron(II) chloride tetrahydrate (10° C.) | 1600 g/l |
| Dipotassium hydrogen phosphate | 1600 g/l |
| Citric acid monohydrate | 1630 g/l |
| Ammonium thiocyanate (19° C.) | 1650 g/l |
| Tripotassium citrate monohydrate (25° C.) | 1670 g/l |
| Magnesium chloride hexahydrate | 1670 g/l |
| Ammonium iodide | 1700 g/l |
| Cesium sulfate | 1790 g/l |
| Sodium iodide | 1790 g/l |
| Cesium chloride | 1800 g/l |
| Zinc nitrate hexahydrate | 1800 g/l |
| Zinc nitrate tetrahydrate | 1800 g/l |
| Ammonium amidosulfonate | 1950 g/l |
| Sucrose (15° C.) | 1970 g/l |
| Manganese(II) chloride tetrahydrate | 1980 g/l |
| Dipotassium tartrate hemihydrate | 2000 g/l |
| Sodium perchlorate monohydrate (15° C.) | 2090 g/l |
| Potassium thiocyanate | 2170 g/l |
| D-(+)-Mannose (17° C.) | 2480 g/l |
| Melibiose monohydrate (25° C.) | 2500 g/l |
| Potassium acetate | 2530 g/l |
| Cesium carbonate | 2615 g/l |
| Zinc chloride | 3680 g/l |
| D-(−)-Fructose | 3750 g/l |
| Manganese(II) nitrate tetrahydrate | 3800 g/l |
| Zinc iodide | 4500 g/l |
| Calcium choride hexahydrate | 5360 g/l |

In the context of the present invention it is preferred to use coating materials which in addition to their solubility in water and the improvement in the physical properties of the laundry detergent and cleaning product tablets, which is associated with their use as a coating, bring about further positive effects. This means that in the context of the present invention it is preferred to use coating materials which in the washing or cleaning operation additionally exhibit detersive or supporting properties. Thus it is possible for a further property of the coating to consist in adjusting the pH of the washing or cleaning liquor; alternatively, it may improve the primary detergency or secondary detergency of the laundry detergent and cleaning product tablets.

Coating materials, or partial coating constituents, which are preferred in the context of the present invention are the following substances:

| | |
|---|---|
| Sodium carbonate monohydrate, sodium carbonate decahydrate | 210 g/l |
| Disodium hydrogen phosphate dodecahydrate | 218 g/l |
| Potassium dihydrogen phosphate | 222 g/l |
| Potassium hydrogen carbonate | 224 g/l |
| Disodium fumarate (25° C.) | 228 g/l |
| Potassium monopersulfate | 256 g/l |
| Trisodium phosphate dodecahydrate | 258 g/l |
| L(+)-Ascorbic acid | 333 g/l |
| Dipotassium oxalate monohydrate | 360 g/l |
| L-(−)-Malic acid | 363 g/l |
| Ammonium dihydrogen phoshate | 370 g/l |
| Potassium hydrogen sulfate | 490 g/l |
| Sodium acetate | 490 g/l |

-continued

| | |
|---|---|
| Sodium peroxodisulphate | 556 g/l |
| Ammonium peroxodisulfate | 582 g/l |
| Sodium gluconate (25° C.) | 590 g/l |
| Sodium hydrogen sulfate monohydrate | 670 g/l |
| Diammonium hydrogen phosphate | 690 g/l |
| Trisodium citrate dihydrate (25° C.) | 720 g/l |
| Maleic acid (25° C.) | 788 g/l |
| Tripotassium phosphate heptahydrate | 900 g/l |
| Trisodium citrate 5.5-hydrate (25° C.) | 920 g/l |
| Ammonium carbonate | 1000 g/l |
| Sodium polyphosphate | 1000 g/l |
| Sodium dihydrogen phosphate monohydrate | 1103 g/l |
| Sodium acetate trihydrate | 1190 g/l |
| Malonic acid | 1390 g/l |
| DL-Malic acid (26° C.) | 1440 g/l |
| Dipotassium hydrogen phosphate | 1600 g/l |
| Citronic acid monohydrate | 1630 g/l |
| Tripotassium citrate monohydrate (25° C.) | 1670 g/l |
| Dipotassium tartrate hemihydrate | 2000 g/l |
| Potassium acetate | 2530 g/l |
| Cesium carbonate | 2615 g/l |

Likewise suitable for use with preference as coating materials are carboxylic or dicarboxylic acids, preferably those having an even number of carbon atoms. Particularly preferred carboxylic or dicarboxylic acids are those having at least 4, preferably at least 6, with particular preference at least 8, and in particular from 8 to 13, carbon atoms. Examples of particularly preferred dicarboxylic acids are adipic acid, pimelic acid, suberic acid, azeleic acid, sebacic acid, undecanoic acid, dodecanoic acid, brassylic acid and mixtures thereof. Suitable coating materials also include tetradecanoic acid, pentadecanoic acid and thapsic acid. Particularly preferred carboxylic acids are those having 12 to 22 carbon atoms, special preference being given to those having 18 to 22 carbon atoms.

Thus laundry detergent or cleaning product tablets wherein the coating comprises carboxylic acids, preference being given to those having 12 to 22, more preferably 18 to 22 carbon atoms, and among these particular preference being given to the species having an even number of carbon atoms, are a further preferred embodiment of the present invention. A likewise preferred embodiment comprises laundry detergent or cleaning product tablets wherein the coating comprises dicarboxylic acids, preference being given to those having at least 4, more preferably having at least 6, with particular preference having at least 8, and in particular those having 8 to 13 carbon atoms, and among these particular preference being given to the species having an even number of carbon atoms. With regard to the particularly preferred individual compounds from the abovementioned groups of carboxylic and dicarboxylic acids, reference may be made to the above remarks.

Further suitable coating materials are film-forming substances. Among these, preference is given in turn to polyalkylene glycols, especially polyethylene glycols and polypropylene glycols, polymers and copolymers of (meth) acrylic acid, especially copolymers of acrylic acid and maleic acid, and also sugars.

Suitable polyalkylene glycols include in particular polyethylene glycols and polypropylene glycols. Particularly preferred coating materials are those from the group of polyethylene glycols (PEG) and/or polypropylene glycols (PPG), preference being given to polyethylene glycols having molecular masses of between 1500 and 36,000, particular preference to those having molecular masses of from 2000 to 6000, and special preference to those having molecular masses from 3000 to 5000. Polyethylene glycols are polymers of ethylene glycol which satisfy the general formula I $$H—(O—CH_2—CH_2)_n—OH \quad (I)$$

in which n may adopt values between 1 (ethylene glycol) and several thousand. For preferred PEG, n adopts values between 20 and approximately 1000. The abovementioned preferred molecular weight ranges correspond to preferred ranges of the value n in formula I of from approximately 30 to approximately 820 (precisely: from 34 to 818), with particular preference from approximately 40 to approximately 150 (precisely: from 45 to 136), and in particular from approximately 70 to approximately 120 (precisely: from 68 to 113).

For polyethylene glycols there exist various nomenclatures, which may lead to confusion. It is common in the art to state the average relative molecular weight after the letters "PEG", so that "PEG 2000" characterizes a polyethylene glycol having a relative molecular mass of about 2000 g $mol^{-1}$. For cosmetic ingredients, a different nomenclature is used, in which the abbreviation PEG is provided with a hyphen and the hyphen is followed directly by a number which corresponds to the number n in the abovementioned formula I. According to this nomenclature (known as the INCI nomenclature, CTFA International Cosmetic Ingredient Dictionary and Handbook, 5th Edition, The Cosmetic, Toiletry and Fragrance Association, Washington, 1997), for example, PEG-33 to PEG-136 may be used with preference. Polyethylene glycols are available commercially, for example, under the trade names Carbowax® PEG 2000 (Union Carbide), Emkapol® 2000 (ICI Americas), Lipoxol® 2000 MED (HÜLS America), Polyglycol® E-2000 (Dow Chemical), Alkapol® PEG 3000 (Rhone-Poulenc), Lutrol® E3000 (BASF), and the corresponding trade names with higher numbers.

Polypropylene glycols (abbreviation PPGs) are polymers of propylene glycol which satisfy the general formula II

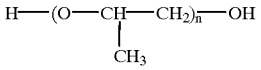

(II)

in which n may adopt values between 1 (propylene glycol) and several thousand. In preferred embodiments, n adopts values between 10 and 2000. Preferred PPGs have molecular masses of between 1000 and 10,000, corresponding to values of n of between 17 and approximately 170.

The polymers of (meth)acrylic acid, especially the copolymers of acrylic acid and maleic acid, are known as cobuilders for laundry detergents or cleaning products. They are described later on below.

The term "sugars" in the context of the present invention characterizes single and multiple sugars, i.e., monosaccharides and oligosaccharides in which from 2 to 6 monosaccharides are connected to one another in acetal fashion. "Sugars" in the context of the present invention are therefore monosaccharides, disaccharides, trisaccharides, and tetra-, penta- and hexasaccharides.

Monosaccharides are linear polyhydroxy aldehydes (aldoses) or polyhydroxy ketones (ketoses). They generally have a chain length of five (pentoses) or six (hexoses) carbon atoms. Monosaccharides having more (heptoses, octoses, etc.) or fewer (tetroses) carbon atoms are relatively uncommon. Some monosaccharides have a large number of asymmetric carbon atoms. For a hexose having four asymmetric carbon atoms, the resulting number of stereoisomers is 24. The orientation of the OH group on the highest-numbered asymmetric carbon atom in the Fischer projection divides the monosaccharides into series with D and L configuration. In the naturally occurring monosaccharides, the D configuration is by far the most common. Where possible, monosaccharides form intramolecular hemiacetals, giving annular structures of the pyran (pyranoses) and furan (furanoses) types. Smaller rings are unstable, larger rings stable only in aqueous solutions. The cyclization produces a further asymmetric carbon atom (known as the anomeric carbon atom) which doubles the number of possible stereoisomers. This is expressed by means of the prefixes α- and β-. The formation of the hemiacetals is a dynamic process which is dependent on various factors such as temperature, solvent, pH, etc. In the majority of cases, mixtures of both anomeric forms are present, in some cases also as mixtures of the furanose and pyranose forms.

Examples of monosaccharides which may be used as sugars in the context of the present invention are the tetroses D-(−)-erythrose and D-(−)-threose and also D-(−)-erythrulose, the pentoses D-(−)-ribose, D-(−)-ribulose, D-(−)-arabinose, D-(+)-xylose, D-(−)-xylulose and D-(−)-lyxose, and the hexoses D-(+)-allose, D-(+)-altrose, D-(+)-glucose, D-(+)-mannose, D-(−)-gulose, D-(−)-idose, D-(+)-galactose, D-(+)-talose, D-(+)-psicose, D-(−)-fructose, D-(+)-sorbose and D-(−)-tagatose. The most important and widespread monosaccharides are the following: D-glucose, D-galactose, D-mannose, D-fructose, L-arabinose, D-xylose, D-ribose and 2-deoxy-D-ribose.

Disaccharides are composed of two single monosaccharide molecules (D-glucose, D-fructose, etc.) linked by a glycosidic linkage. If the glycosidic linkage is between the acetal carbon atoms (1 in the case of aldoses or 2 in the case of ketoses) of the two monosaccharides, then the ring form is fixed in both: the sugars exhibit no mutarotation, do not react with ketone reagents, and no longer have a reducing action (Fehling's-negative: trehalose or saccharose type). If, on the other hand, the glycosidic linkage connects the acetal carbon atom of one monosaccharide with any carbon atom of the second, then the monosaccharide may also adopt the open-chain form, and the sugar continues to have a reducing action (Fehling's-positive: maltose type).

The most important disaccharides are saccharose (cane sugar, sucrose) trehalose, lactose (milk sugar), lactulose, maltose (malt sugar), cellobiose (degradation product of cellulose), gentobiose, melibiose, turanose, and others.

Trisaccharides are carbohydrates composed of 3 monosaccharides linked glycosidically with one another, for which the incorrect designation trioses is occasionally encountered. Trisaccharides are relatively uncommon in nature: examples are gentianose, kestose, maltotriose, melecitose, raffinose, and, as examples of trisaccharides containing amino sugars, streptomycin and validamycin.

Tetrasaccharides are oligosaccharides with 4 monosaccharide units. Examples of this class of compound are stachyose, lychnose (galactose-glucose-fructose-galactose) and secalose (comprising 4 fructose units).

In the context of the present invention, preferred sugars used are saccharides from the group consisting of glucose, fructose, saccharose, cellobiose, maltose, lactose, lactulose, ribose, and mixtures thereof. Particular preference is given to laundry detergent or cleaning product tablets whose coatings comprise glucose and/or saccharose.

In laundry detergent or cleaning product tablets which are preferred in the context of the present invention, the coating comprises film-forming substances, especially from the groups of the polyethylene glycols and/or polypropylene glycols, the copolymers of acrylic acid and maleic acid, or the sugars.

In addition, polymers other than those specified so far may be used with particular preference as coating materials. In this case, preference is given to laundry detergent or cleaning product tablets of the invention wherein the coating comprises a polymer or polymer mixture selected from a) water-soluble nonionic polymers from the group of
- a1) polyvinylpyrrolidones
- a2) vinylpyrrolidone-vinyl ester copolymers
- a3) cellulose ethers b) water-soluble amphoteric polymers from the group of
- b1) alkylacrylamide-acrylic acid copolymers
- b2) alkylacrylamide-methacrylic acid copolymers
- b3) alkylacrylamide-methylmethacrylic acid copolymers
- b4) alkylacrylamide-acrylic acid-alkylaminoalkyl(meth) acrylic acid copolymers
- b5) alkylacrylamide-methacrylic acid-alkylaminoalkyl (meth)acrylic acid copolymers
- b6) alkylacrylamide-methylmethacrylic acid-alkylaminoalkyl(meth)acrylic acid copolymers
- b7) alkylacrylamide-alkyl methacrylate-alkylaminoethyl methacrylate-alkyl methacrylate copolymers
- b8) copolymers of
  - b8i) unsaturated carboxylic acids
  - b8ii) cationically derivatized unsaturated carboxylic acids
  - b8iii) if desired, further ionic or nonionic monomers c) water-soluble zwitterionic polymers from the group of
- c1) acrylamidoalkyltrialkylammonium chlorideacrylic acid copolymers and their alkali metal and ammonium salts
- c2) acrylamidoalkyltrialkylammonium chloridemethacrylic acid copolymers and their alkali metal and ammonium salts
- c3) methacroylethyl betaine-methacrylate copolymers d) water-soluble anionic polymers from the group of
- d1) vinyl acetate-crotonic acid copolymers
- d2) vinylpyrrolidone-vinyl acrylate copolymers
- d3) acrylic acid-ethyl acrylate-N-tert-butylacrylamide terpolymers
- d4) graft polymers of vinyl esters, esters of acrylic acid or methacrylic acid alone or in a mixture, copolymerized with crotonic acid, acrylic acid or methacrylic acid with polyalkylene oxides and/or polyalkylene glycols
- d5) grafted and crosslinked copolymers from the copolymerization of
  - d5i) at least one monomer of the nonionic type,
  - d5ii) at least one monomer of the ionic type,
  - d5iii) polyethylene glycol, and
  - d5iv) a crosslinker
- d6) copolymers obtained by copolymerizing at least one monomer from each of the three following groups:
  - d6i) esters of unsaturated alcohols and short-chain saturated carboxylic acids and/or esters of short-chain saturated alcohols and unsaturated carboxylic acids,
  - d6ii) unsaturated carboxylic acids,
  - d6iii) esters of long-chain carboxylic acids and unsaturated alcohols and/or esters of the carboxylic acids of group d6ii) with saturated or unsaturated, straight-chain or branched $C_{8-18}$ alcohol d7) terpolymers of crotonic acid, vinyl acetate and an allyl or methallyl ester d8) tetra- and pentapolymers of d8i) crotonic acid or allyloxyacetic acid d8ii) vinyl acetate or vinyl propionate d8iii) branched allyl or methallyl esters d8iv) vinyl ethers, vinyl esters or straight-chain allyl or methallyl esters d9) crotonic acid copolymers with one or more monomers from the group consisting of ethylene, vinylbenzene, vinyl methyl ether, acrylamide and water-soluble salts thereof d10) terpolymers of vinyl acetate, crotonic acid and vinyl esters of a saturated aliphatic α-branched monocarboxylic acid e) water-soluble cationic polymers from the group of e1) quaternized cellulose derivatives e2) polysiloxanes with quaternary groups e3) cationic guar derivatives e4) polymeric dimethyldiallylammonium salts and their copolymers with esters and amides of acrylic acid and methacrylic acid e5) copolymers of vinylpyrrolidone with quaternized derivatives of dialkylaminoacrylate and -methacrylate e6) vinylpyrrolidone-methoimidazolinium chloride copolymers e7) quaternized polyvinyl alcohol e8) polymers indicated under the INCI designations Polyquaternium 2, Polyquaternium 17, Polyquaternium 18, and Polyquaternium 27.

Water-soluble polymers in the sense of the invention are those polymers which are soluble to the extent of more than 2.5% by weight at room temperature in water.

These preferred laundry detergent or cleaning product tablets of the invention are partially coated with a polymer or polymer mixture, said polymer (and, accordingly, the overall partial coating) or at least 50% by weight of the polymer mixture (and thus at least 50% of the partial coating) being selected from defined polymers. The partial coating consists wholly or to the extent of at least 50% of its weight of water-soluble polymers from the group of the nonionic, amphoteric, zwitterionic, anionic and/or cationic polymers. These polymers are described in more detail below.

Water-soluble polymers which are preferred in accordance with the invention are nonionic. Examples of suitable nonionic polymers are the following:

Polyvinylpyrrolidones, as marketed, for example, under the designation Luviskol® (BASF). Polyvinylpyrrolidones are preferred nonionic polymers in the context of the invention.

Polyvinylpyrrolidones [poly(1-vinyl-2-pyrrolidinones)], abbreviated PVP, are polymers of the general formula (III)

(III)

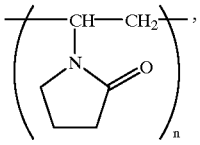

prepared by free-radical addition polymerization of 1-vinylpyrrolidone by processes of solution or suspension polymerization using free-radical initiators (peroxides, azo compounds). The ionic polymerization of the monomer yields only products having low molecular masses. Commercially customary polyvinylpyrrolidones have molecular masses in the range from approx. 2500–750,000 g/mol, which are characterized by stating the K values and—depending on the K value—have glass transition temperatures of 130–175°. They are supplied as white, hygroscopic powders or as aqueous solutions. Polyvinylpyrrolidones are readily soluble in water and a large number of organic solvents (alcohols, ketones, glacial acetic acid, chlorinated hydrocarbons, phenols, etc).

Vinylpyrrolidone-vinyl ester copolymers, as marketed for example under the trademark Luviskol® (BASF). Luviskol® VA 64 and Luviskol® VA 73, each vinylpyrrolidone-vinyl acetate copolymers, are particularly preferred nonionic polymers.

The vinyl ester polymers are polymers obtainable from vinyl esters and featuring the grouping of the formula (IV)

(IV)

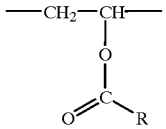

as the characteristic basic structural unit of the macromolecules. Of these, the vinyl acetate polymers ($R=CH_3$) with polyvinyl acetates, as by far the most important representatives, have the greatest industrial significance.

The vinyl esters are polymerized free-radically by various processes (solution polymerization, suspension polymerization, emulsion polymerization, and bulk polymerization). Copolymers of vinyl acetate with vinylpyrrolidone comprise monomer units of the formulae (II) and (IV)

Cellulose ethers, such as hydroxypropylcellulose, hydroxyethylcellulose and methylhydroxypropylcellulose, as marketed for example under the trademarks Culminal® and Benecel® (AQUALON).

Cellulose ethers may be described by the general formula V)

(V)

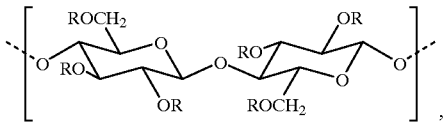

where R is H or an alkyl, alkenyl, alkynyl, aryl, or alkylaryl radical. In preferred products, at least one R in formula (V) is $—CH_2CH_2CH_2—OH$ or $—CH_2CH_2—OH$. Cellulose ethers are prepared industrially by etherifying alkali metal cellulose (e.g., with ethylene oxide). Cellulose ethers are characterized by way of the average degree of substitution, DS, and/or by the molar degree of substitution, MS, which indicate how many hydroxyl groups of an anhydroglucose unit of cellulose have reacted with the etherifying reagent or how many moles of the etherifying reagent have been added on, on average, to one anhydroglucose unit.

Hydroxyethylcelluloses are water-soluble above a DS of approximately 0.6 and, respectively, an MS of approximately 1. Commercially customary hydroxyethyl- and hydroxypropylcelluloses have degrees of substitution in the range of 0.85–1.35 (DS) and 1.5–3 (MS), respectively. Hydroxyethyl- and -propylcelluloses are marketed as yellowish white, odorless and tasteless powders in greatly varying degrees of polymerization. Hydroxyethyl- and -propylcelluloses are soluble in cold and hot water and in some (water-containing) organic solvents, but insoluble in the majority of (anhydrous) organic solvents; their aqueous solutions are relatively insensitive to changes in pH or addition of electrolyte.

Further polymers suitable in accordance with the invention are water-soluble amphopolymers. The generic term amphopolymers embraces amphoteric polymers, i.e., polymers whose molecule includes both free amino groups and free —COOH or $SO_3H$ groups and which are capable of forming inner salts; zwitterionic polymers whose molecule includes quaternary ammonium groups and —$COO^-$ OR —$SO_3^-$ groups, and polymers containing —COOH or $SO_3H$ groups and quaternary ammonium groups. An example of an amphopolymer which may be used in accordance with the invention is the acrylic resin obtainable under the designation Amphomer®, which constitutes a copolymer of tert-butylaminoethyl methacrylate, N-(1,1,3,3-tetramethylbutyl) acrylamide, and two or more monomers from the group consisting of acrylic acid, methacrylic acid and their simple esters. Likewise preferred amphopolymers are composed of unsaturated carboxylic acids (e.g., acrylic and methacrylic acid), cationically derivatized unsaturated carboxylic acids, (e.g., acrylamidopropyltrimethylammonium chloride), and, if desired, further ionic or nonionic monomers, as evident, for example, from German Laid-Open Specification 39 29 973 and the prior art cited therein. Terpolymers of acrylic acid, methyl acrylate and methacrylamidopropyltrimonium chloride, as obtainable commercially under the designation Merquat® 2001 N, are particularly preferred amphopolymers in accordance with the invention. Further suitable amphoteric polymers are, for example, the octylacrylamide-methyl methacrylate-tert-butylaminoethyl methacrylate-2-hydroxypropyl methacrylate copolymers available under the designations Amphomer® and Amphomer® LV-71 (DELFT NATIONAL).

Examples of suitable zwitterionic polymers are the addition polymers disclosed in German Patent Applications DE 39 29 973, DE 21 50 557, DE 28 17 369 and DE 37 08 451. Acrylamidopropyltrimethylammonium chloride-acrylic acid or -methacrylic acid copolymers and their alkali metal salts and ammonium salts are preferred zwitterionic polymers. Further suitable zwitterionic polymers are methacryloylethyl betainemethacrylate copolymers, which are obtainable commercially under the designation Amersette® (AMERCHOL).

Anionic polymers that are suitable in accordance with the invention include:

Vinyl acetate-crotonic acid copolymers, as commercialized, for example, under the designations Resyn® (NATIONAL STARCH), Luviset® (BASF) and Gafset® (GAF).

In addition to monomer units of the above formula (IV), these polymers also have monomer units of the general formula (VI):

$$[—CH(CH_3)—CH(COOH)—]_n \quad (VI)$$

Vinylpyrrolidone-vinyl acrylate copolymers, obtainable for example under the trademark Luviflex® (BASF). A preferred polymer is the vinylpyrrolidone-acrylate terpolymer obtainable under the designation Luviflex® VBM-35 (BASF).

Acrylic acid-ethyl acrylate-N-tert-butylacrylamide terpolymers, which are marketed for example under the designation Ultrahold® strong (BASF).

Graft polymers of vinyl esters, esters of acrylic acid or methacrylic acid alone or in a mixture, copolymerized with crotonic acid, acrylic acid or methacrylic acid with polyalkylene oxides and/or polyalkylene glycols Such grafted polymers of vinyl esters, esters of acrylic acid or methacrylic acid alone or in a mixture with other copolymerizable compounds onto polyalkylene glycols are obtained by polymerization under hot conditions in homogeneous phase, by stirring the polyalkylene glycols into the monomers of the vinyl esters, esters of acrylic acid or methacrylic acid, in the presence of free-radical initiators.

Vinyl esters which have been found suitable are, for example, vinyl acetate, vinyl propionate, vinyl butyrate, vinyl benzoate, and esters of acrylic acid or methacrylic acid which have been found suitable are those obtainable with low molecular weight aliphatic alcohols, i.e., in particular, ethanol, propanol, isopropanol, 1-butanol, 2-butanol, 2-methyl-1-propanol, 2-methyl-2-propanol, 1-pentanol, 2-pentanol, 3-pentanol, 2,2-dimethyl-1-propanol, 3-methyl-1-butanol, 3-methyl-2-butanol, 2-methyl-2-butanol, 2-methyl-1-butanol, and 1-hexanol.

Suitable polyalkylene glycols include in particular polyethylene glycols and polypropylene glycols. These have already been described earlier on above and are characterized by the general formulae I and II, respectively.

In particular, it is possible to use the vinyl acetate copolymers grafted onto polyethylene glycols and the polymers of vinyl acetate and crotonic acid grafted onto polyethylene glycols.

Grafted and crosslinked copolymers from the copolymerization of i) at least one monomer of the nonionic type, ii) at least one monomer of the ionic type, iii) polyethylene glycol, and iv) a crosslinker The polyethylene glycol used has a molecular weight of between 200 and several million, preferably between 300 and 30,000.

The nonionic monomers may be of very different types and include the following preferred monomers: vinyl acetate, vinyl stearate, vinyl laurate, vinyl propionate, allyl stearate, allyl laurate, diethyl maleate, allyl acetate, methyl methacrylate, cetyl vinyl ether, stearyl vinyl ether, and 1-hexene.

The nonionic monomers may equally be of very different types, among which particular preference is given to the presence in the graft polymers of crotonic acid, allyloxyacetic acid, vinylacetic acid, maleic acid, acrylic acid, and methacrylic acid.

Preferred crosslinkers are ethylene glycol dimethacrylate, diallyl phthalate, ortho-, meta- and para-divinylbenzene, tetraallyloxyethane, and polyallylsaccharoses containing 2 to 5 allyl groups per molecule of saccharin.

The above-described grafted and crosslinked copolymers are formed preferably of:

i) from 5 to 85% by weight of at least one monomer of the nonionic type, ii) from 3 to 80% by weight of at least one monomer of the ionic type, iii) from 2 to 50% by weight, preferably from 5 to 30% by weight, of polyethylene glycol, and iv) from 0.1 to 8% by weight of a crosslinker, the percentage of the crosslinker depending on the ratio of the overall weights of i), ii) and iii).

Copolymers obtained by copolymerizing at least one monomer from each of the three following groups:

i) esters of unsaturated alcohols and short-chain saturated carboxylic acids and/or esters of short-chain saturated alcohols and unsaturated carboxylic acids, ii) unsaturated carboxylic acids, iii) esters of long-chain carboxylic acids and unsaturated alcohols and/or esters of the carboxylic acids of group ii) with saturated or unsaturated, straight-chain or branched $C_{8-18}$ alcohol Short-chain carboxylic acids and alcohols here are those having 1 to 8 carbon atoms, it being possible for the carbon chains of these compounds to be interrupted, if desired, by divalent hetero-groups such as —O—, —NH—, and —S—.

Terpolymers of crotonic acid, vinyl acetate, and an allyl or methallyl ester

These terpolymers contain monomer units of the general formulae (IV) and (VI) (see above) and also monomer units of one or more allyl or methallyl esters of the formula VII:

(VII)

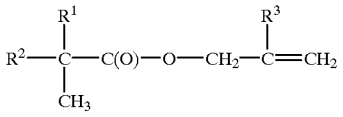

in which $R^3$ is —H or —$CH_3$, $R^2$ is —$CH_3$ or —$CH(CH_3)_2$ and $R^1$is —$CH_3$ or a saturated straight-chain or branched $C_{1-6}$ alkyl radical and the sum of the carbon atoms in the radicals $R^1$ and $R^2$ is preferably 7, 6, 5, 4, 3 or 2.

The abovementioned terpolymers result preferably from the copolymerization of from 7 to 12% by weight of crotonic acid, from 65 to 86% by weight, preferably from 71 to 83% by weight, of vinyl acetate and from 8 to 20% by weight, preferably from 10 to 17% by weight, of allyl or methallyl esters of the formula VII.

Tetra- and pentapolymers of i) crotonic acid or allyloxyacetic acid ii) vinyl acetate or vinyl propionate iii) branched allyl or methallyl esters iv) vinyl ethers, vinyl esters or straight-chain allyl or methallyl esters Crotonic acid copolymers with one or more monomers from the group consisting of ethylene, vinylbenzene, vinyl methyl ether, acrylamide and the water-soluble salts thereof Terpolymers of vinyl acetate, crotonic acid and vinyl esters of a saturated aliphatic α-branched monocarboxylic acid.

Further polymers which may be used with preference as coating constituents are cationic polymers. Among the cationic polymers, the permanently cationic polymers are preferred. "Permanently cationic" refers according to the invention to those polymers which independently of the pH of the composition (i.e., both of the coating and of the tablet) have a cationic group. These are generally polymers which include a quaternary nitrogen atom, in the form of an ammonium group, for example.

Examples of preferred cationic polymers are the following:

Quaternized cellulose derivatives, as available commercially under the designations Celquat® and Polymer JR®. The compounds Celquat® H 100, Celquat® L 200 and Polymer JR® 400 are preferred quaternized cellulose derivatives.

Polysiloxanes with quaternary groups, such as, for example, the commercially available products Q2-7224 (manufacturer: Dow Corning; a stabilized trimethylsilylamodimethicone), Dow Corning® 929 emulsion (comprising a hydroxyl-amino-modified silicone, also referred to as amodimethicone), SM-2059 (manufacturer: General Electric), SLM-55067 (manufacturer: Wacker), and Abil®-Quat 3270 and 3272 (manufacturer: Th. Goldschmidt; diquaternary polydimethylsiloxanes, Quaternium-80), Cationic guar derivatives, such as in particular the products marketed under the trade names Cosmedia® Guar and Jaguar®, Polymeric dimethyldiallylammonium salts and their copolymers with esters and amides of acrylic acid and methacrylic acid. The products available commercially under the designations Merquat® 100 (poly (dimethyldiallylammonium chloride)) and Merquat® 550 (dimethyldiallylammonium chlorideacrylamide copolymer) are examples of such cationic polymers.

Copolymers of vinylpyrrolidone with quaternized derivatives of dialkylamino acrylate and methacrylate, such as, for example, diethyl sulfate-quaternized vinylpyrrolidone-dimethylamino methacrylate copolymers. Such compounds are available commercially under the designations Gafquat® 734 and Gafquat® 755.

Vinylpyrrolidone-methoimidazolinium chloride copolymers, as offered under the designation Luviquat®.

Quaternized polyvinyl alcohol and also polymers known under the designations

Polyquaternium 2

Polyquaternium 17,

Polyquaternium 18, and

Polyquaternium 27, having quaternary nitrogen atoms in the polymer main chain. These polymers are designated in accordance with the INCI nomenclature; detailed information can be found in the CTFA International Cosmetic Ingredient Dictionary and Handbook, 5th Edition, The Cosmetic, Toiletry and Fragrance Association, Washington, 1997, which is expressly incorporated herein by reference.

Cationic polymers which are preferred in accordance with the invention are quaternized cellulose derivatives and also polymeric dimethyldiallylammonium salts and copolymers thereof. Cationic cellulose derivatives, especially the commercial product Polymer® JR 400, are especially preferred cationic polymers.

In order to make the partial coating even more resistant to mechanical stress, polyurethanes may be incorporated into the coating. They give the coating elasticity and stability and in accordance with the above-indicated quantity of water-soluble polymers may account for up to 50% by weight of the coating.

Polyurethanes are water-soluble in the sense of the invention if they are soluble to the extent of less than 2.5% by weight at room temperature in water.

The polyurethanes comprise at least two different monomer types:

a compound (A) having at least two active hydrogen atoms per molecule, and a di- or polyisocyanate (B).

The compounds (A) may comprises, for example, diols, triols, diamines, triamines, polyetherols, and polyesterols. The compounds having more than 2 active hydrogen atoms are usually used only in small amounts in combination with a large excess of compounds having 2 active hydrogen atoms.

Examples of compounds (A) are ethylene glycol, 1,2- and 1,3-propylene glycol, butylene glycols, di-, tri-, tetra- and polyethylene and -propylene glycols, copolymers of lower alkylene oxides such as ethylene oxide, propylene oxide and butylene oxide, ethylenediamine, prolylenediamine, 1,4-diaminobutane, hexamethylenediamine and α,ω-diamines based on long-chain alkanes or polyalkylene oxides.

Polyurethanes wherein the compounds (A) are diols, triols and polyetherols may be preferred in accordance with the invention. In particular, polyethylene glycols and polypropylene glycols having molecular masses of between 200 and 3000, in particular between 1600 and 2500, have proven particularly suitable in certain cases. Polyesterols are normally obtained by modifying the compound (A) with dicarboxylic acids such as phthalic acid, isophthalic acid, and adipic acid.

As compounds (B), use is made predominantly of hexamethylene diisocyanate, 2,4- and 2,6-toluene diisocyanate, 4,4'-methylenedi(phenyl isocyanate), and, in particular, isophorone diisocyanate. These compounds may be described by the general formula VIII:

$$O{=}C{=}N{-}R^4{-}N{=}C{=}O \qquad \text{(VIII)},$$

in which $R^4$ is a connecting group of carbon atoms, for example, a methylene, ethylene, propylene, butylene, pentylene, hexylene, etc., group. In the abovementioned hexamethylene diisocyanate (HMDI), which is the one used most frequently in industry, $R^4=(CH_2)_6$; in 2,4- and 2,6-toluene diisocyanate (TDI), $R^4$ is $C_6H_3{-}CH_3$), in 4,4'-methylenedi(phenyl isocyanate) (MDI) $R^4$ is $C_6H_4{-}CH_2{-}C_6H_4$) and in isophorone diisocyanate, $R^4$ is the isophorone radical (3,5,5-trimethyl-2-cyclohexenone).

Furthermore, the polyurethanes used in accordance with the invention may also include structural units such as, for example, diamines as chain extenders, and hydroxy carboxylic acids. Dialkylolcarboxylic acids such as, for example, dimethylolpropionic acid are particularly suitable hydroxy carboxylic acids. With regard to the other structural units there is no fundamental restriction as to whether they comprise nonionic, anionic or cationic structural units.

Concerning further information regarding the structure and the preparation of the polyurethanes, reference is made expressly to the articles in the relevant overview works such as Röpps Chemie-Lexikon and Ullmanns Enzyklopädie der technischen Chemie.

Polyurethanes which have proven particularly suitable in accordance with the invention in many cases are those which may be characterized as follows:

exclusively aliphatic groups in the molecule no free isocyanate groups in the molecule polyether- and polyesterpolyurethanes anionic groups in the molecule.

It has also proven advantageous for the preparation of the coated laundry detergent and cleaning product tablets of the invention if the polyurethanes have not been mixed directly with the other components of the partial coating but instead have been introduced in the form of aqueous dispersions. Such dispersions normally have a solids content of approximately 20–50%, in particular about 35–45%, and are also available commercially.

In addition to the coating materials, the partial coating may comprise further ingredients which enhance the physical properties of the coating or give the coated tablet advantageous properties. For example, it is possible to incorporate what are known as minor components such as, for example, dyes or optical brighteners or foam inhibitors into the coating. If coating materials are used which dissolve poorly or slowly in water, then it is possible to incorporate disintegration aids into the coating. Those laundry detergent or cleaning product tablets of the invention wherein the coating further comprises a disintegration aid in amounts of from 0.1 to 10% by weight, preferably from 0.2 to 7.5% by weight and in particular from 0.25 to 5% by weight, based in each case on the coat, are preferred in the context of the present invention.

The use of the disintegration aids described in detail later on below is particularly advisable in the case of acid coats, in which case customary concentrations for the disintegration aids in the coats are from 0.1 to 5% by weight, based on the coat.

Above, the constituents of the partial coating of the tablets of the invention have been described in detail. Below, the constituents of the tablets per se, i.e., of the uncoated tablets, are described. These tablets are sometimes referred to below as "base tablets" in order to establish a verbal delimitation from the term "tablet" for the coated laundry detergent and cleaning product tablets of the invention; in some cases, however, the general term "tablet" is used. Since the present invention provides base tablets provided with a partial coating, the statements made below for the base tablets do of course also apply to laundry detergent and cleaning product tablets of the invention which meet the corresponding conditions, and vice versa.

The base tablets comprise, as essential constituents, builder(s) and surfactant(s). The base tablets of the invention may comprise all of the builders commonly used in laundry detergents and cleaning products, i.e., in particular, zeolites, silicates, carbonates, organic cobuilders, and—where there are no ecological prejudices against their use—phosphates as well.

Suitable crystalline, layered sodium silicates possess the general formula $NaMSi_xO_{2x+1}.yH_2O$, where M is sodium or hydrogen, x is a number from 1.9 to 4, y is a number from 0 to 20, and preferred values for x are 2, 3 or 4. Crystalline phyllosilicates of this kind are described, for example, in European Patent Application EP-A-0 164 514. Preferred crystalline phyllosilicates of the formula indicated are those in which M is sodium and x adopts the value 2 or 3. In particular, both β- and δ-sodium disilicates $Na_2Si_2O_5.yH_2O$ are preferred, β-sodium disilicate, for example, being obtainable by the process described in International Patent Application WO-A-91/08171.

It is also possible to use amorphous sodium silicates having an $Na_2O:SiO_2$ modulus of from 1:2 to 1:3.3, preferably from 1:2 to 1:2.8, and in particular from 1:2 to 1:2.6, which are dissolution-retarded and have secondary washing properties. The retardation of dissolution relative to conventional amorphous sodium silicates may have been brought about in a variety of ways—for example, by surface treatment, compounding, compacting, or overdrying. In the context of this invention, the term "amorphous" also embraces "X-ray-amorphous". This means that in X-ray diffraction experiments the silicates do not yield the sharp X-ray reflections typical of crystalline substances but instead yield at best one or more maxima of the scattered X-radiation, having a width of several degree units of the diffraction angle. However, good builder properties may result, even particularly good builder properties, if the silicate particles in electron diffraction experiments yield vague or even sharp diffraction maxima. The interpretation of this is that the products have microcrystalline regions with a size of from 10 to several hundred nm, values up to max. 50 nm and in particular up to max. 20 nm being preferred. So-called X-ray-amorphous silicates of this kind, which likewise possess retarded dissolution relative to the conventional waterglasses, are described, for example, in German Patent Application DE-A-44 00 024. Particular preference is given to compacted amorphous silicates, compounded amorphous silicates, and overdried X-ray-amorphous silicates.

The finely crystalline, synthetic zeolite used, containing bound water, is preferably zeolite A and/or P. A particularly preferred zeolite P is Zeolite MAP® (commercial product from Crosfield). Also suitable, however, are zeolite X and also mixtures of A, X and/or P. A product available commercially and able to be used with preference in the context of the present invention, for example, is a cocrystallizate of zeolite X and zeolite A (approximately 80% by weight zeolite X), which is sold by CONDEA Augusta S.p.A. under the brand name VEGOBOND AX® and may be described by the formula $$nNa_2O.(1-n)K_2O.Al_2O_3.(2-2.5)SiO_2.(3.5-5.5)H_2O.$$

The zeolite may be used either as a builder in a granular compound or as a kind of "powdering" for the entire mixture intended for compression, it being common to utilize both methods for incorporating the zeolite into the premix. Suitable zeolites have an average particle size of less than 10 $\mu$m (volume distribution; measurement method: Coulter counter) and contain preferably from 18 to 22% by weight, in particular from 20 to 22% by weight, of bound water.

Of course, the widely known phosphates may also be used as builder substances provided such a use is not to be avoided on ecological grounds. Among the large number of commercially available phosphates, the alkali metal phosphates, with particular preference being given to pentasodium and pentapotassium triphosphate (sodium and potassium tripolyphosphate, respectively), possess the greatest importance in the laundry detergent and cleaning product industry.

Alkali metal phosphates is the collective term for the alkali metal (especially sodium and potassium) salts of the various phosphoric acids, among which metaphosphoric acids $(HPO_3)_n$ and orthophosphoric acid $H_3PO_4$, in addition to higher-molecular-mass representatives, may be distinguished. The phosphates combine a number of advantages: they act as alkali carriers, prevent limescale deposits on machine components, and lime incrustations on fabrics, and additionally contribute to cleaning performance.

Sodium dihydrogen phosphate, $NaH_2PO_4$, exists as the dihydrate (density 1.91 g cm$^{-3}$, melting point 60°) and as the monohydrate (density 2.04 g cm$^{-3}$). Both salts are white powders of very ready solubility in water which lose the water of crystallization on heating and undergo conversion at 200° C. into the weakly acidic diphosphate (disodium dihydrogen diphosphate, $Na_2H_2P_2O_7$) and at the higher temperature into sodium trimetaphosphate ($Na_3P_3O_9$) and Maddrell's salt (see below). $NaH_2PO_4$ reacts acidically; it is formed if phosphoric acid is adjusted to a pH of 4.5 using sodium hydroxide solution and the slurry is sprayed. Potassium dihydrogen phosphate (primary or monobasic potassium phosphate, potassium biphosphate, PDP), $KH_2PO_4$, is a white salt with a density of 2.33 g cm$^{-3}$, has a melting point of 253° [decomposition with formation of potassium polyphosphate $(KPO_3)_x$], and is readily soluble in water.

Disodium hydrogen phosphate (secondary sodium phosphate), $Na_2HPO_4$, is a colorless, crystalline salt which is very readily soluble in water. It exists in anhydrous form and with 2 mol (density 2.066 g cm$^{-3}$, water loss at 95°), 7 mol (density 1.68 g cm$^{-3}$, melting point 48° with loss of 5 $H_2O$), and 12 mol of water (density 1.52 g cm$^{-3}$, melting point 35° with loss of $H_2O$), becomes anhydrous at 100°, and if heated more severely undergoes transition to the diphosphate $Na_4P_2O_7$. Disodium hydrogen phosphate is prepared by neutralizing phosphoric acid with sodium carbonate solution using phenolphthalein as indicator. Dipotassium hydrogen phosphate (secondary or dibasic potassium phosphate), $K_2HPO_4$, is an amorphous white salt which is readily soluble in water.

Trisodium phosphate, tertiary sodium phosphate, $Na_3PO_4$, exists as colorless crystals which as the dodecahydrate have a density of 1.62 g cm$^{-3}$ and a melting point of 73–76° C. (decomposition), as the decahydrate (corresponding to 19–20% $P_2O_5$) have a melting point of 100° C., and in anhydrous form (corresponding to 39–40% $P_2O_5$) have a density of 2.536 g cm$^{-3}$. Trisodium phosphate is readily soluble in water, with an alkaline reaction, and is prepared by evaporative concentration of a solution of precisely 1 mol of disodium phosphate and 1 mol of NaOH. Tripotassium phosphate (tertiary or tribasic potassium phosphate), $K_3PO_4$, is a white, deliquescent, granular powder of density 2.56 g cm$^{-3}$, has a melting point of 1340°, and is readily soluble in water with an alkaline reaction. It is produced, for example, when Thomas slag is heated with charcoal and potassium sulfate. Despite the relatively high price, the more readily soluble and therefore highly active potassium phosphates are frequently preferred in the cleaning products industry over the corresponding sodium compounds.

Tetrasodium diphosphate (sodium pyrophosphate), $Na_4P_2O_7$, exists in anhydrous form (density 2.534 g cm$^{-3}$, melting point 988°, 880° also reported) and as the decahydrate (density 1.815–1.836 g cm$^{-3}$, melting point 94° with loss of water). Both substances are colorless crystals which dissolve in water with an alkaline reaction. $Na_4P_2O_7$ is formed when disodium phosphate is heated at >200° or by reacting phosphoric acid with sodium carbonate in stoichiometric ratio and dewatering the solution by spraying. The decahydrate complexes heavy metal salts and water hardeners and therefore reduces the hardness of the water. Potassium diphosphate (potassium pyrophosphate), $K_4P_2O_7$, exists in the form of the trihydrate and is a colorless, hygroscopic powder of density 2.33 g cm$^{-3}$ which is soluble in water, the pH of the 1% strength solution at 250 being 10.4.

Condensation of $NaH_2PO_4$ or of $KH_2PO_4$ gives rise to higher-molecular-mass sodium and potassium phosphates, among which it is possible to distinguish cyclic representatives, the sodium and potassium metaphosphates, and catenated types, the sodium and potassium polyphosphates. For the latter in particular a large number of names are in use: fused or calcined phosphates, Graham's salt, Kurrol's and Maddrell's salt. All higher sodium and potassium phosphates are referred to collectively as condensed phosphates.

The industrially important pentasodium triphosphate, $Na_5P_3O_{10}$ (sodium tripolyphosphate), is a nonhygroscopic, white, water-soluble salt which is anhydrous or crystallizes with 6 $H_2O$ and has the general formula NaO—[P(O)(ONa)—O]$_n$—Na where n=3. About 17 g of the anhydrous salt dissolve in 100 g of water at room temperature, at 60° about 20 g, at 100° around 32 g; after heating the solution at 100° C. for two hours, about 8% orthophosphate and 15% diphosphate are produced by hydrolysis. For the preparation of pentasodium triphosphate, phosphoric acid is reacted with sodium carbonate solution or sodium hydroxide solution in stoichiometric ratio and the solution is dewatered by spraying. In a similar way to Graham's salt and sodium diphosphate, pentasodium triphosphate dissolves numerous insoluble metal compounds (including lime soaps, etc). Pentapotassium triphosphate, $K_5P_3O_{10}$ (potassium tripolyphosphate), is commercialized, for example, in the form of a 50% strength by weight solution (>23% $P_2O_5$, 25% $K_2O$). The potassium polyphosphates find broad application in the laundry detergents and cleaning products industry. There also exist sodium potassium tripolyphosphates, which may likewise be used for the purposes of the present invention. These are formed, for example, when sodium trimetaphosphate is hydrolyzed with KOH:

$$(NaPO_3)_3+2KOH \rightarrow Na_3K_2P_3O_{10}+H_2O$$

They can be used in accordance with the invention in precisely the same way as sodium tripolyphospate, potassium tripolyphosphate, or mixtures of these two; mixtures of sodium tripolyphosphate and sodium potassium tripolyphosphate, or mixtures of potassium tripolyphosphate and sodium potassium tripolyphosphate, or mixtures of sodium tripolyphosphate and potassium tripolyphosphate and sodium potassium tripolyphospate, may also be used in accordance with the invention.

Organic cobuilders which may be used in the base tablets of the invention are, in particular, polycarboxylates/polycarboxylic acids, polymeric polycarboxylates, aspartic acid, polyacetals, dextrins, further organic cobuilders (see below), and phosphonates. These classes of substance are described below.

Organic builder substances which may be used are, for example, the polycarboxylic acids, usable in the form of their sodium salts, the term polycarboxylic acids meaning those carboxylic acids which carry more than one acid function. Examples of these are citric acid, adipic acid, succinic acid, glutaric acid, malic acid, tartaric acid, maleic acid, fumaric acid, sugar acids, amino carboxylic acids, nitrilotriacetic acid (NTA), provided such use is not objectionable on ecological grounds, and also mixtures thereof. Preferred salts are the salts of the polycarboxylic acids such as citric acid, adipic acid, succinic acid, glutaric acid, tartaric acid, sugar acids, and mixtures thereof.

The acids per se may also be used. In addition to their builder effect, the acids typically also possess the property of an acidifying component and thus also serve to establish a lower and milder pH of laundry detergents or cleaning products. In this context, mention may be made in particular of citric acid, succinic acid, glutaric acid, adipic acid, gluconic acid, and any desired mixtures thereof.

Also suitable as builders are polymeric polycarboxylates; these are, for example, the alkali metal salts of polyacrylic acid or of polymethacrylic acid, examples being those having a relative molecular mass of from 500 to 70,000 g/mol.

The molecular masses reported for polymeric polycarboxylates, for the purposes of this document, are weight-average molecular masses, $M_w$, of the respective acid form, determined basically by means of gel permeation chromatography (GPC) using a UV detector. The measurement was made against an external polyacrylic acid standard, which owing to its structural similarity to the polymers under investigation provides realistic molecular weight values. These figures differ markedly from the molecular weight values obtained using polystyrenesulfonic acids as the standard. The molecular masses measured against polystyrenesulfonic acids are generally much higher than the molecular masses reported in this document.

Suitable polymers are, in particular, polyacrylates, which preferably have a molecular mass of from 2000 to 20,000 g/mol. Owing to their superior solubility, preference in this group may be given in turn to the short-chain polyacrylates, which have molecular masses of from 2000 to 10,000 g/mol, and with particular preference from 3000 to 5000 g/mol.

Also suitable are copolymeric polycarboxylates, especially those of acrylic acid with methacrylic acid and of acrylic acid or methacrylic acid with maleic acid. Copolymers which have been found particularly suitable are those of acrylic acid with maleic acid which contain from 50 to 90% by weight acrylic acid and from 50 to 10% by weight maleic acid. Their relative molecular mass, based on free acids, is generally from 2000 to 70,000 g/mol, preferably from 20,000 to 50,000 g/mol, and in particular from 30,000 to 40,000 g/mol.

The (co)polymeric polycarboxylates can be used either as powders or as aqueous solutions. The (co)polymeric polycarboxylate content of the compositions is preferably from 0.5 to 20% by weight, in particular from 3 to 10% by weight.

In order to improve the solubility in water, the polymers may also contain allylsulfonic acids, such as allyloxybenzenesulfonic acid and methallylsulfonic acid, for example, as monomers.

Particular preference is also given to biodegradable polymers comprising more than two different monomer units, examples being those comprising, as monomers, salts of acrylic acid and of maleic acid, and also vinyl alcohol or vinyl alcohol derivatives, or those comprising, as monomers, salts of acrylic acid and of 2-alkylallylsulfonic acid, and also sugar derivatives.

Further preferred copolymers are those described in German Patent Applications DE-A-43 03 320 and DE-A-44 17 734, whose monomers are preferably acrolein and acrylic acid/acrylic acid salts, and, respectively, acrolein and vinyl acetate.

Similarly, further preferred builder substances that may be mentioned include polymeric amino dicarboxylic acids, their salts or their precursor substances. Particular preference is given to polyaspartic acids and their salts and derivatives, which are disclosed in German Patent Application DE-A-195 40 086 to have not only cobuilder properties but also a bleach-stabilizing action.

Further suitable builder substances are polyacetals, which may be obtained by reacting dialdehydes with polyol carboxylic acids having 5 to 7 carbon atoms and at least 3 hydroxyl groups. Preferred polyacetals are obtained from dialdehydes such as glyoxal, glutaraldehyde, terephthalaldehyde and mixtures thereof and from polyol carboxylic acids such as gluconic acid and/or glucoheptonic acid.

Further suitable organic builder substances are dextrins, examples being oligomers and polymers of carbohydrates, which may be obtained by partial hydrolysis of starches. The hydrolysis can be conducted by customary processes; for example, acid-catalyzed or enzyme-catalyzed processes. The hydrolysis products preferably have average molecular masses in the range from 400 to 500,000 g/mol. Preference is given here to a polysaccharide having a dextrose equivalent (DE) in the range from 0.5 to 40, in particular from 2 to 30, DE being a common measure of the reducing effect of a polysaccharide in comparison to dextrose, which possesses a DE of 100. It is possible to use both maltodextrins having a DE of between 3 and 20 and dried glucose syrups having a DE of between 20 and 37, and also so-called yellow dextrins and white dextrins having higher molecular masses, in the range from 2000 to 30,000 g/mol.

The oxidized derivatives of such dextrins comprise their products of reaction with oxidizing agents which are able to oxidize at least one alcohol function of the saccharide ring to the carboxylic acid function. Oxidized dextrins of this kind, and processes for preparing them, are known, for example, from European Patent Applications EP-A-0 232 202, EP-A-0 427 349, EP-A-0 472 042 and EP-A-0 542 496 and from International Patent Applications WO 92/18542, WO 93/08251, WO 93/16110, WO 94/28030, WO 95/07303, WO 95/12619 and WO 95/20608. Likewise suitable is an oxidized oligosaccharide in accordance with German Patent Application DE-A-196 00 018. A product oxidized at $C_6$ of the saccharide ring may be particularly advantageous.

Oxydisuccinates and other derivatives of disuccinates, preferably ethylenediamine disuccinate, are further suitable cobuilders. Ethylenediamine N,N'-disuccinate (EDDS) is used preferably in the form of its sodium or magnesium salts. Further preference in this context is given to glycerol disuccinates and glycerol trisuccinates as well. Suitable use amounts in formulations containing zeolite and/or silicate are from 3 to 15% by weight.

Examples of further useful organic cobuilders are acetylated hydroxy carboxylic acids and their salts, which may also be present in lactone form and which contain at least 4 carbon atoms, at least one hydroxyl group, and not more than two acid groups. Such cobuilders are described, for example, in International Patent Application WO 95/20029.

A further class of substance having cobuilder properties is represented by the phosphonates. The phosphonates in question are, in particular, hydroxyalkane- and aminoalkanephosphonates. Among the hydroxyalkanephosphonates, 1-hydroxyethane-1,1-diphosphonate (HEDP) is of particular importance as a cobuilder. It is used preferably as the sodium salt, the disodium salt being neutral and the tetrasodium salt giving an alkaline (pH 9) reaction. Suitable aminoalkanephosphonates are preferably ethylenediaminetetramethylenephosphonate (EDTMP), diethylenetriaminepentamethylenephosphonate (DTPMP), and their higher homologs. They are used preferably in the form of the neutrally reacting sodium salts, e.g., as the hexasodium salt of EDTMP or as the hepta- and octasodium salt of DTPMP. As a builder in this case, preference is given to using HEDP from the class of the phosphonates. Furthermore, the aminoalkanephosphonates possess a pronounced heavy metal binding capacity. Accordingly, and especially if the compositions also contain bleach, it may be preferred to use aminoalkanephosphonates, expecially DTPMP, or to use mixtures of said phosphonates.

Furthermore, all compounds capable of forming complexes with alkaline earth metal ions may be used as cobuilders.

The amount of builder is usually between 10 and 70% by weight, preferably between 15 and 60% by weight, and in particular between 20 and 50% by weight. In turn, the amount of builders used is dependent on the intended use, so that bleach tablets and tablets for machine dishwashing may contain higher amounts of builders (for example, between 20 and 70% by weight, preferably between 25 and 65% by weight, and in particular between 30 and 55% by weight) than, say, laundry detergent tablets (usually from 10 to 50% by weight, preferably from 12.5 to 45% by weight, and in particular between 17.5 and 37.5% by weight).

Preferred base tablets further comprise one or more surfactants. In the base tablets it is possible to use anionic, nonionic, cationic and/or amphoteric surfactants, and/or mixtures thereof. From a performance standpoint, preference is given to mixtures of anionic and nonionic surfactants. The total surfactant content of the tablets is from 5 to 60% by weight, based on the tablet weight, preference being given to surfactant contents of more than 15% by weight.

Anionic surfactants used are, for example, those of the sulfonate and sulfate type. Preferred surfactants of the sulfonate type are $C_{9-13}$ alkylbenzenesulfonates, olefinsulfonates, i.e., mixtures of alkenesulfonates and hydroxyalkanesulfonates, and also disulfonates, as are obtained, for example, from $C_{12-18}$ monoolefins having a terminal or internal double bond by sulfonating with gaseous sulfur trioxide followed by alkaline or acidic hydrolysis of the sulfonation products. Also suitable are alkanesulfonates, which are obtained from $C_{12-18}$ alkanes, for example, by sulfochlorination or sulfoxidation with subsequent hydrolysis or neutralization, respectively. Likewise suitable, in addition, are the esters of $\alpha$-sulfo fatty acids (ester sulfonates), e.g., the $\alpha$-sulfonated methyl esters of hydrogenated coconut, palm kernel or tallow fatty acids.

Further suitable anionic surfactants are sulfated fatty acid glycerol esters. Fatty acid glycerol esters are the monoesters, diesters and triesters, and mixtures thereof, as obtained in the preparation by esterification of a monoglycerol with from 1 to 3 mol of fatty acid or in the transesterification of triglycerides with from 0.3 to 2 mol of glycerol. Preferred sulfated fatty acid glycerol esters are the sulfation products of saturated fatty acids having 6 to 22 carbon atoms, examples being those of caproic acid, caprylic acid, capric acid, myristic acid, lauric acid, palmitic acid, stearic acid, or behenic acid.

Preferred alk(en)yl sulfates are the alkali metal salts, and especially the sodium salts, of the sulfuric monoesters of $C_{12}$–$C_{18}$ fatty alcohols, examples being those of coconut fatty alcohol, tallow fatty alcohol, lauryl, myristyl, cetyl or stearyl alcohol, or of $C_{10}$–$C_{20}$ oxo alcohols, and those monoesters of secondary alcohols of these chain lengths. Preference is also given to alk(en)yl sulfates of said chain length which contain a synthetic straight-chain alkyl radical prepared on a petrochemical basis, these sulfates possessing degradation properties similar to those of the corresponding compounds based on fatty-chemical raw materials. From a detergents standpoint, the $C_{12}$–$C_{16}$ alkyl sulfates and $C_{12}$–$C_{15}$ alkyl sulfates, and also $C_{14}$–$C_{15}$ alkyl sulfates, are preferred. In addition, 2,3-alkyl sulfates, which may for example be prepared in accordance with U.S. Pat. Nos. 3,234,258 or 5,075,041 and obtained as commercial products from Shell Oil Company under the name DAN®, are suitable anionic surfactants.

Also suitable are the sulfuric monoesters of the straight-chain or branched $C_{7-21}$ alcohols ethoxylated with from 1 to 6 mol of ethylene oxide, such as 2-methyl-branched $C_{9-11}$ alcohols containing on average 3.5 mol of ethylene oxide (EO) or $C_{12-18}$ fatty alcohols containing from 1 to 4 EO. Because of their high foaming behavior they are used in cleaning products only in relatively small amounts, for example, in amounts of from 1 to 5% by weight.

Further suitable anionic surfactants include the salts of alkylsulfosuccinic acid, which are also referred to as sulfosuccinates or as sulfosuccinic esters and which constitute monoesters and/or diesters of sulfosuccinic acid with alcohols, preferably fatty alcohols and especially ethoxylated fatty alcohols. Preferred sulfosuccinates comprise $C_{8-18}$ fatty alcohol radicals or mixtures thereof. Especially preferred sulfosuccinates contain a fatty alcohol radical derived from ethoxylated fatty alcohols which themselves represent nonionic surfactants (for description, see below). Particular preference is given in turn to sulfosuccinates whose fatty alcohol radicals are derived from ethoxylated fatty alcohols having a narrowed homolog distribution. Similarly, it is also possible to use alk(en)ylsuccinic acid containing preferably 8 to 18 carbon atoms in the alk(en)yl chain, or salts thereof.

Further suitable anionic surfactants are, in particular, soaps. Suitable soaps include saturated fatty acid soaps, such as the salts of lauric acid, myristic acid, palmitic acid, stearic acid, hydrogenated erucic acid and behenic acid, and, in particular, mixtures of soaps derived from natural fatty acids, e.g., coconut, palm kernel, or tallow fatty acids.

The anionic surfactants, including the soaps, may be present in the form of their sodium, potassium or ammonium salts and also as soluble salts of organic bases, such as mono-, di- or triethanolamine. Preferably, the anionic surfactants are in the form of their sodium or potassium salts, in particular in the form of the sodium salts.

Nonionic surfactants used are preferably alkoxylated, advantageously ethoxylated, especially primary, alcohols having preferably 8 to 18 carbon atoms and on average from 1 to 12 mol of ethylene oxide (EO) per mole of alcohol, in which the alcohol radical may be linear or, preferably, methyl-branched in position 2 and/or may comprise linear and methyl-branched radicals in a mixture, as are commonly present in oxo alcohol radicals. In particular, however, preference is given to alcohol ethoxylates containing linear radicals from alcohols of natural origin having 12 to 18 carbon atoms, e.g., from coconut, palm, tallow fatty or oleyl alcohol and on average from 2 to 8 EO per mole of alcohol. Preferred ethoxylated alcohols include, for example, $C_{12-14}$ alcohols containing 3 EO or 4 EO, $C_{12-14}$ alcohol containing 7 EO, $C_{13-15}$ alcohols containing 3 EO, 5 EO, 7 EO or 8 EO, $C_{12-18}$ alcohols containing 3 EO, 5 EO or 7 EO, and mixtures thereof, such as mixtures of $C_{12-14}$ alcohol containing 3 EO and $C_{12-18}$ alcohol containing 5 EO. The stated degrees of ethoxylation represent statistical mean values, which for a specific product may be an integer or a fraction. Preferred alcohol ethoxylates have a narrowed homolog distribution (narrow range ethoxylates, NREs). In addition to these nonionic surfactants it is also possible to use fatty alcohols containing more than 12 EO. Examples thereof are tallow fatty alcohol containing 14 EO, 25 EO, 30 EO or 40 EO.

As further nonionic surfactants, furthermore, use may also be made of alkyl glycosides of the general formula $RO(G)_x$, where R is a primary straight-chain or methyl-branched aliphatic radical, especially an aliphatic radical methyl-branched in position 2, containing 8 to 22, preferably 12 to 18, carbon atoms, and G is the symbol representing a glycose unit having 5 or 6 carbon atoms, preferably glucose. The degree of oligomerization, x, which indicates the distribution of monoglycosides and oligoglycosides, is any desired number between 1 and 10; preferably, x is from 1.2 to 1.4.

A further class of nonionic surfactants used with preference, which are used either as sole nonionic surfactant or in combination with other nonionic surfactants, are alkoxylated, preferably ethoxylated, or ethoxylated and propoxylated, fatty acid alkyl esters, preferably having 1 to 4 carbon atoms in the alkyl chain, especially fatty acid methyl esters, as are described, for example, in Japanese Patent Application JP 58/217598, or those prepared preferably by the process described in International Patent Application WO-A-90/13533.

Nonionic surfactants of the amine oxide type, examples being N-cocoalkyl-N,N-dimethylamine oxide and N-tallowalkyl-N,N-dihydroxyethylamine oxide, and of the fatty acid alkanolamide type, may be also be suitable. The amount of these nonionic surfactants is preferably not more than that of the ethoxylated fatty alcohols, in particular not more than half thereof.

Further suitable surfactants are polyhydroxy fatty acid amides of the formula (IX),

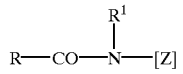

(IX)

where RCO is an aliphatic acyl radical having 6 to 22 carbon atoms, $R^1$ is hydrogen or an alkyl or hydroxyalkyl radical having 1 to 4 carbon atoms, and [Z] is a linear or branched polyhydroxyalkyl radical having 3 to 10 carbon atoms and from 3 to 10 hydroxyl groups. The polyhydroxy fatty acid amides are known substances which are customarily obtainable by reductive amination of a reducing sugar with ammonia, an alkylamine or an alkanolamine, and subsequent acylation with a fatty acid, a fatty acid alkyl ester or a fatty acid chloride.

The group of the polyhydroxy fatty acid amides also includes compounds of the formula (X)

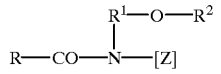

(X)

where R is a linear or branched alkyl or alkenyl radical having 7 to 12 carbon atoms, $R^1$ is a linear, branched or cyclic alkyl radical or an aryl radical having 2 to 8 carbon atoms and $R^2$ is a linear, branched or cyclic alkyl radical or an aryl radical or an oxyalkyl radical having 1 to 8 carbon atoms, preference being given to $C_{1-4}$ alkyl radicals or phenyl radicals, and [Z] is a linear polyhydroxyalkyl radical whose alkyl chain is substituted by at least two hydroxyl groups, or alkoxylated, preferably ethoxylated or propoxylated, derivatives of said radical.

[Z] is preferably obtained by reductive amination of a reduced sugar, e.g., glucose, fructose, maltose, lactose, galactose, mannose, or xylose. The N-alkoxy- or N-aryloxy-substituted compounds may then be converted to the desired polyhydroxy fatty acid amides, for example, in accordance with the teaching of International Patent Application WO-A-95/07331 by reaction with fatty acid methyl esters in the presence of an alkoxide as catalyst.

In the context of the present invention, preference is given to base tablets comprising anionic and nonionic surfactant(s); performance advantages may result from certain proportions in which the individual classes of surfactant are used.

For example, particular preference is given to base tablets in which the ratio of anionic surfactant(s) to nonionic surfactant(s) is between 10:1 and 1:10, preferably between 7.5:1 and 1:5, and in particular between 5:1 and 1:2.

Preference is also given to laundry detergent and cleaning product tablets which comprise anionic and/or nonionic surfactant(s) and have total surfactant contents of more than 2.5% by weight, preferably more than 5% by weight, and in particular more than 10% by weight, based in each case on the tablet weight. Particularly preferred are laundry detergent and cleaning product tablets comprising surfactant(s), preferably anionic and/or nonionic surfactant(s), in amounts of from 5 to 40% by weight, preferably from 7.5 to 35% by weight, with particular preference from 10 to 30% by weight, and in particular from 12.5 to 25% by weight, based in each case on the tablet weight.

From a performance standpoint it may be advantageous if certain classes of surfactant are absent from some phases of the base tablets or from the tablet as a whole, i.e., from all phases. A further important embodiment of the present invention therefore envisages that at least one phase of the tablets is free from nonionic surfactants.

Conversely, however, the presence of certain surfactants in individual phases or in the whole tablet, i.e., in all phases, may produce a positive effect. The incorporation of the above-described alkyl polyglycosides has been found advantageous, and so preference is given to base tablets in which at least one phase of the tablets comprises alkyl polyglycosides.

Similarly to the case with the nonionic surfactants, the omission of anionic surfactants from certain phases or all phases may also result in base tablets better suited to certain fields of application. In the context of the present invention, therefore, it is also possible to conceive of laundry detergent and cleaning product tablets in which at least one phase of the tablets is free from anionic surfactants.

As already mentioned, the use of surfactants in the case of cleaning product tablets for machine dishwashing is preferably limited to the use of nonionic surfactants in small amounts. Laundry detergent and cleaning product tablets preferred for use as cleaning product tablets in the context of the present invention are those wherein the base tablet has total surfactant contents of less than 5% by weight, preferably less than 4% by weight, with particular preference less than 3% by weight, and in particular less than 2% by weight, based in each case on the weight of the base tablet. Surfactants used in machine dishwashing compositions are usually only low-foaming nonionic surfactants. Representatives from the groups of the anionic, cationic and amphoteric surfactants, in contrast, are of relatively little importance. With particular preference, the cleaning product tablets of the invention for machine dishwashing comprise nonionic surfactants, especially nonionic surfactants from the group of the alkoxylated alcohols. Preferred nonionic surfactants used are alkoxylated, advantageously ethoxylated, especially primary alcohols having preferably 8 to 18 carbon atoms and on average from 1 to 12 mol of ethylene oxide (EO) per mole of alcohol, in which the alcohol radical may be linear or, preferably, methyl-branched in position 2 and/or may contain a mixture of linear and methyl-branched radicals, as are customarily present in oxo alcohol radicals. Particular preference is given, however, to alcohol ethoxylates having linear radicals from alcohols of natural origin having 12 to 18 carbon atoms, e.g., from coconut, palm, tallow fatty or oleyl alcohol, and having on average from 2 to 8 EO per mole of alcohol. The preferred ethoxylated alcohols include, for example, $C_{12-14}$ alcohols having 3 EO or 4 EO, $C_{9-11}$ alcohol having 7 EO, $C_{13-15}$ alcohols having 3 EO, 5 EO, 7 EO or 8 EO, $C_{12-18}$ alcohols having 3 EO, 5 EO or 7 EO, and mixtures of these, such as mixtures of $C_{12-14}$ alcohol having 3 EO and $C_{12-18}$ alcohol having 5 EO. The stated degrees of ethoxylation are statistical means, which for a specific product may be an integer or a fraction. Preferred alcohol ethoxylates have a narrowed homolog distribution (narrow range ethoxylates, NREs). In addition to these nonionic surfactants, fatty alcohols having more than 12 EO may also be used. Examples thereof are tallow fatty alcohol having 14 EO, 25 EO, 30 EO, or 40 EO.

Especially in connection with inventive laundry detergent tablets or cleaning product tablets for machine dishwashing, it is preferred for the laundry detergent and cleaning product tablets to comprise a nonionic surfactant having a melting point above room temperature. Accordingly, the laundry detergent or cleaning product tablets of the invention preferably comprise a nonionic surfactant having a melting point above 20° C. Nonionic surfactants whose use is preferred have melting points above 25° C., nonionic surfactants whose use is particularly preferred have melting points of between 25 and 60° C., in particular between 26.6 and 43.30° C.

Suitable nonionic surfactants having melting or softening points within the stated temperature range are, for example, low-foaming nonionic surfactants which may be solid or highly viscous at room temperature. If nonionic surfactants which are highly viscous at room temperature are used, then it is preferred that they have a viscosity above 20 Pas, preferably above 35 Pas, and in particular above 40 Pas. Also preferred are nonionic surfactants which possess a waxlike consistency at room temperature.

Preferred nonionic surfactants for use that are solid at room temperature originate from the groups of alkoxylated nonionic surfactants, especially the ethoxylated primary alcohols, and mixtures of these surfactants with surfactants of more complex construction such as polyoxypropylene/polyoxyethylene/polyoxypropylene (PO/EO/PO) surfactants. Such (PO/EO/PO) nonionic surfactants are notable, furthermore, for good foam control.

In one preferred embodiment of the present invention, the nonionic surfactant having a melting point above room temperature is an ethoxylated nonionic surfactant originating from the reaction of a monohydroxy alkanol or alkylphenol having 6 to 20 carbon atoms with preferably at least 12 mol, with particular preference at least 15 mol, in particular at least 20 mol, of ethylene oxide per mole of alcohol or alkylphenol, respectively.

A particularly preferred nonionic surfactant for use that is solid at room temperature is obtained from a straight-chain fatty alcohol having 16 to 20 carbon atoms ($C_{16-20}$ alcohol), preferably a $C_{18}$ alcohol, and at least 12 mol, preferably at least 15 mol, and in particular at least 20 mol of ethylene oxide. Of these, the so-called "narrow range ethoxylates" (see above) are particularly preferred.

The nonionic surfactant which is solid at room temperature preferably further possesses propylene oxide units in the molecule. Preferably, such PO units account for up to 25% by weight, with particular preference up to 20% by weight, and in particular up to 15% by weight, of the overall molar mass of the nonionic surfactant. Particularly preferred nonionic surfactants are ethoxylated monohydroxy alkanols or alkylphenols, which additionally comprise polyoxyethylene-polyoxypropylene block copolymer units. The alcohol or alkylphenol moiety of such nonionic surfactant molecules in this case makes up preferably more than 30% by weight, with particular preference more than 50% by weight, and in particular more than 70% by weight, of the overall molar mass of such nonionic surfactants.

Further nonionic surfactants whose use is particularly preferred, have melting points above room temperature, contain from 40 to 70% of a polyoxypropylene/polyoxyethylene/polyoxypropylene block polymer blend which comprises 75% by weight of an inverted block copolymer of polyoxyethylene and polyoxypropylene containing 17 mol of ethylene oxide and 44 mol of propylene oxide and 25% by weight of a block copolymer of polyoxyethylene and polyoxypropylene, initiated with trimethylolpropane and containing 24 mol of ethylene oxide and 99 mol of propylene oxide per mole of trimethylolpropane.

Nonionic surfactants which may be used with particular preference are, for example, obtainable under the name Poly Tergent® SLF-18 from the company Olin Chemicals.

A further preferred surfactant may be described by the formula $$R^1O[CH_2CH(CH_3)O]_x[CH_2CH_2O]_y[CH_2CH(OH)R^2]$$

in which $R^1$ is a linear or branched aliphatic hydrocarbon radical having 4 to 18 carbon atoms, or mixtures thereof, $R^2$ is a linear or branched hydrocarbon radical having 2 to 26 carbon atoms, or mixtures thereof, and x is between 0.5 and 1.5, and y is at least 15.

Further nonionic surfactants which may be used with preference are the endgroup-capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x is between 1 and 30, k and j are between 1 and 12, preferably between 1 and 5. Where $x \geqq 2$, each $R^3$ in the above formula may be different. $R^1$ and $R^2$ are preferably linear or branched, saturated or unsaturated, aliphatic or aromatic hydrocarbon radicals having 6 to 22 carbon atoms, radicals having 8 to 18 carbon atoms being particularly preferred. For the radical $R^3$, H, —$CH_3$ or —$CH_2CH_3$ are particularly preferred. Particularly preferred values for x lie within the range from 1 to 20, in particular from 6 to 15.

As described above, each $R^3$ in the above formula may be different if $x \geqq 2$. By this means it is possible to vary the alkylene oxide unit in the square brackets. If x, for example, is 3, the radical $R^3$ may be selected in order to form ethylene oxide ($R^3$=H), or propylene oxide ($R^3$=$CH_3$) units, which may be added on to one another in any sequence, examples being (EO) (PO) (EO), (EO) (EO) (PO), (EO) (EO) (EO), (PO) (EO) (PO), (PO) (PO) (EO) and (PO) (PO) (PO). The value of 3 for x has been chosen by way of example in this case and it is entirely possible for it to be larger, the scope for variation increasing as the values of x go up and embracing, for example, a large number of (EO) groups, combined with a small number of (PO) groups, or vice versa.

Particularly preferred endgroup-capped poly (oxyalkylated) alcohols of the above formula have values of k=1 and j=1, thereby simplifying the above formula to $$R^1O[CH_2CH(R^3)O]_xCH_2CH\ (OH)CH_2OR^2.$$

In the last-mentioned formula, $R^1$, $R^2$ and $R^3$ are as defined above and x stands for numbers from 1 to 30, preferably from 1 to 20, and in particular from 6 to 18. Particular preference is given to surfactants wherein the radicals $R^1$ and $R^2$ have 9 to 14 carbon atoms, $R^3$ is H, and x adopts values from 6 to 15.

In order to facilitate the disintegration of highly compacted tablets, it is possible to incorporate disintegration aids, known as tablet disintegrants, into the tablets in order to reduce the disintegration times. Tablet disintegrants, or disintegration accelerators, are understood in accordance with Römpp (9th Edition, Vol. 6, p. 444) and Voigt "*Lehrbuch der pharmazeutischen Technologie*" [Textbook of pharmaceutical technology] (6th Edition, 1987, pp. 182–184) to be auxiliaries which ensure the rapid disintegration of tablets in water or gastric fluid and the release of the drugs in absorbable form.

These substances increase in volume on ingress of water, with on the one hand an increase in the intrinsic volume (swelling) and on the other hand, by way of the release of gases, the generation of a pressure which causes the tablets to disintegrate into smaller particles. Examples of established disintegration aids are carbonate/citric acid systems, with the use of other organic acids also being possible. Examples of swelling disintegration aids are synthetic polymers such as polyvinylpyrrolidone (PVP) or natural polymers and/or modified natural substances such as cellulose and starch and their derivatives, alginates, or casein derivatives.

Preferred base tablets contain from 0.5 to 10% by weight, preferably from 3 to 7% by weight, and in particular from 4 to 6% by weight, of one or more disintegration aids, based in each case on the tablet weight.

Preferred disintegrants used in the context of the present invention are cellulose-based disintegrants and so preferred base tablets comprise a cellulose-based disintegrant of this kind in amounts from 0.5 to 10% by weight, preferably from 3 to 7% by weight, and in particular from 4 to 6% by weight. Pure cellulose has the formal empirical composition $(C_6H_{10}O_5)_n$ and, considered formally, is a β-1,4-polyacetal of cellobiose, which itself is constructed of two molecules of glucose. Suitable celluloses consist of from about 500 to 5000 glucose units and, accordingly, have average molecular masses of from 50,000 to 500,000. Cellulose-based disintegrants which can be used also include, in the context of the present invention, cellulose derivatives obtainable by polymeranalogous reactions from cellulose. Such chemically modified celluloses include, for example, products of esterifications and etherifications in which hydroxy hydrogen atoms have been substituted. However, celluloses in which the hydroxyl groups have been replaced by functional groups not attached by an oxygen atom may also be used as cellulose derivatives. The group of the cellulose derivatives embraces, for example, alkali metal celluloses, carboxymethylcellulose (CMC), cellulose esters and cellulose ethers and aminocelluloses. Said cellulose derivatives are preferably not used alone as cellulose-based disintegrants but instead are used in a mixture with cellulose. The cellulose derivative content of these mixtures is preferably less than 50% by weight, with particular preference less than 20% by weight, based on the cellulose-based disintegrant. The particularly preferred cellulose-based disintegrant used is pure cellulose, free from cellulose derivatives.

The cellulose used as disintegration aid is preferably not used in finely divided form but instead is converted into a coarser form, f or example, by granulation or compaction, before being admixed to the premixes intended for compression. Laundry detergent and cleaning product tablets comprising disintegrants in granular or optionally cogranulated form are described in German Patent Applications DE 197 09 991 (Stefan Herzog) and DE 197 10 254 (Henkel) and in International Patent Application WO98/40463 (Henkel). These documents also provide further details on the production of granulated, compacted or cogranulated cellulose disintegrants. The particle sizes of such disintegrants are usually above 200 μm, preferably between 300 and 1600 μm to the extent of at least 90%, and in particular between 400 and 1200 μm to the extent of at least 90%. The abovementioned, relatively coarse cellulose-based disintegration aids, and those described in more detail in th e cited documents, are preferred for use as cellulose-based disintegration aids in the context of the present invention and are available commercially, for example, under the designation Arbocel® TF-30-HG from the company Rettenmaier.

As a further cellulose-based disintegrant or as a constituent of this component it is possible to use microcrystalline cellulose. This microcrystalline cellulose is obtained by partial hydrolysis of celluloses under conditions which attack only the amorphous regions (approximately 30% of the total cellulose mass) of the celluloses and break them up completely but leave the crystalline regions (approximately 70%) intact. Subsequent deaggregation of the microfine celluloses resulting from the hydrolysis yields the microcrystalline celluloses, which have primary particle sizes of approximately 5 μm and can be compacted, for example, to granules having an average particle size of 200 μm.

Laundry detergent and cleaning product tablets which are preferred in the context of the present invention further comprise a disintegration aid, preferably a cellulose-based disintegration aid, preferably in granular, cogranulated or compacted form, in amounts of from 0.5 to 10% by weight, preferably from 3 to 7% by weight, and in particular from 4 to 6% by weight, based in each case on the tablet weight, with preferred disintegration aids having average particle sizes or more than 300 μm, preferably more than 400 μm, and in particular more than 500 μm.

The laundry detergent and cleaning product tablets of the invention may further comprise, both in the base tablet [part a)] and in the partial coating, a gas-evolving effervescent system. Said gas-evolving effervescent system may consist of a single substance which on contact with water releases a gas. Among these compounds mention may be made, in particular, of magnesium peroxide, which on contact with water releases oxygen. Normally, however, the gas-releasing effervescent system consists in its turn of at least two constituents which react with one another and, in so doing, form gas. Although a multitude of systems which release, for example, nitrogen, oxygen or hydrogen are conceivable and offerable here, the effervescent system used in the laundry detergent and cleaning product tablets of the invention will be selectable on the basis of both economic and environmental considerations. Preferred effervescent systems consist of alkali metal carbonate and/or alkali metal hydrogen carbonate and of an acidifier apt to release carbon dioxide from the alkali metal salts in aqueous solution.

Among the alkali metal carbonates and/or alkali metal hydrogen carbonates, the sodium and potassium salts are much preferred over the other salts on grounds of cost. It is of course not mandatory to use the single alkali metal carbonates or alkali metal hydrogen carbonates in question; rather, mixtures of different carbonates and hydrogen carbonates may be preferred from the standpoint of wash technology.

In preferred laundry detergent and cleaning product tablets, the effervescent system used comprises from 2 to 20% by weight, preferably from 3 to 15% by weight, and in particular from 5 to 10% by weight, of an alkali metal carbonate or alkali metal hydrogen carbonate, and from 1 to 15, preferably from 2 to 12, and in particular from 3 to 10, % by weight of an acidifier, based in each case on the total tablet.

As examples of acidifiers which release carbon dioxide from the alkali metal salts in aqueous solution it is possible to use boric acid and also alkali metal hydrogen sulfates, alkali metal hydrogen phosphates, and other inorganic salts. Preference is given, however, to the use of organic acidifiers, with citric acid being a particularly preferred acidifier. However, it is also possible, in particular, to use the other solid mono-, oligo- and polycarboxylic acids. Preferred among this group, in turn, are tartaric acid, succinic acid, malonic acid, adipic acid, maleic acid, fumaric acid, oxalic acid, and polyacrylic acid. Organic sulfonic acids such as amidosulfonic acid may likewise be used. A commercially available acidifier which is likewise preferred for use in the context of the present invention is Sokalan® DCS (trademark of BASF), a mixture of succinic acid (max. 31% by weight), glutaric acid (max. 50% by weight), and adipic acid (max. 33% by weight).

In addition to the abovementioned constituents, builder, surfactant and disintegration aid, the laundry detergent and cleaning product tablets of the invention may further comprise further customary laundry detergent and cleaning product ingredients from the group consisting of bleaches, bleach activators, dyes, fragrances, optical brighteners, enzymes, foam inhibitors, silicone oils, antiredeposition agents, graying inhibitors, color transfer inhibitors, and corrosion inhibitors.

In order to develop the desired bleaching performance, the laundry detergent and cleaning product tablets of the present invention may comprise bleaches. In this context, the customary bleaches from the group consisting of sodium perborate monohydrate, sodium perborate tetrahydrate, and sodium percarbonate have proven particularly appropriate.

"Sodium percarbonate" is a term used unspecifically for sodium carbonate peroxohydrates, which strictly speaking are not "percarbonates" (i.e., salts of percarbonic acid) but rather hydrogen peroxide adducts onto sodium carbonate. The commercial product has the average composition 2 $Na_2CO_3.3\ H_2O_2$ and is thus not a peroxycarbonate. Sodium percarbonate forms a white, water soluble powder of density 2.14 g $cm^{-3}$ which breaks down readily into sodium carbonate and oxygen having a bleaching or oxidizing action.

Sodium carbonate peroxohydrate was first obtained in 1899 by precipitation with ethanol from a solution of sodium carbonate in hydrogen peroxide, but was mistakenly regarded as a peroxycarbonate. Only in 1909 was the compound recognized as the hydrogen peroxide addition compound; nevertheless, the historical name (sodium percarbonate) has persisted in the art.

Industrially, sodium percarbonate is produced predominantly by precipitation from aqueous solution (known as the wet process). In this process, aqueous solutions of sodium carbonate and hydrogen peroxide are combined and the sodium percarbonate is precipitated by means of salting agents (predominantly sodium chloride), crystallizing aids (for example polyphosphates, polyacrylates), and stabilizers (for example, $Mg^2$ ions). The precipitated salt, which still contains from 5 to 12% by weight of the mother liquor, is subsequently centrifuged and dried in fluidized-bed driers at 90° C. The bulk density of the finished product may vary between 800 and 1200 g/l according to the production process. Generally, the percarbonate is stabilized by an additional coating. Coating processes, and substances used for the coating, are amply described in the patent literature. Fundamentally, it is possible in accordance with the invention to use all commercially customary percarbonate types, as supplied, for example, by the companies Solvay Interox, Degussa, Kemira or Akzo.

In the context of the bleaches used, the amount of these substances in the tablets is dependent on the intended use of the tablets. Whereas customary universal laundry detergents in tablet form contain between 5 and 30% by weight, preferably between 7.5 and 25% by weight, and in particular between 12.5 and 22.5% by weight, of bleach is, the amounts in the case of bleach tablets or bleach booster tablets are between 15 and 50% by weight, preferably between 22.5 and 45% by weight, and in particular between 30 and 40% by weight.

In addition to the bleaches used, the laundry detergent and cleaning product tablets of the invention may comprise bleach activator(s), which is preferred in the context of the present invention. Bleach activators are incorporated into laundry detergents and cleaning products in order to achieve an improved bleaching activity when washing at temperatures of 60° C. or below. Bleach activators which may be used are compounds which under perhydrolysis conditions give rise to aliphatic peroxo carboxylic acids having preferably 1 to 10 carbon atoms, in particular 2 to 4 carbon atoms, and/or substituted or unsubstituted perbenzoic acid. Suitable substances are those which carry O-acyl and/or N-acyl groups of the stated number of carbon atoms, and/or substituted or unsubstituted benzoyl groups. Preference is given to polyacylated alkylenediamines, especially tetraacetylethylenediamine (TAED), acylated triazine derivatives, especially 1,5-diacetyl-2,4-dioxohexahydro-1,3,5-triazine (DADHT), acylated glycolurils, especially tetraacetylglycoluril (TAGU), N-acyl imides, especially N-nonanoylsuccinimide (NOSI), acylated phenolsulfonates, especially n-nonanoyl- or isononanoyloxybenzenesulfonate (n- or iso-NOBS), carboxylic anhydrides, especially phthalic anhydride, acylated polyhydric alcohols, especially triacetin, ethylene glycol diacetate, and 2,5-diacetoxy-2,5-dihydrofuran.

In addition to the conventional bleach activators, or instead of them, it is also possible to incorporate what are known as bleaching catalysts into the tablets. These substances are bleach-boosting transition metal salts or transition metal complexes such as, for example, Mn-, Fe-, Co-, Ru- or Mo-salen complexes or -carbonyl complexes. Other bleaching catalysts which can be used include Mn, Fe, Co, Ru, Mo, Ti, V and Cu complexes with N-containing tripod ligands, and also Co-, Fe-, Cu- and Ru-ammine complexes.

If the tablets of the invention comprise bleach activators, they contain, in each case based on the total tablet, between 0.5 and 30% by weight, preferably between 1 and 20% by weight, and in particular between 2 and 15%, of one or more bleach activators or bleaching catalysts. Depending on the intended use of the tablets produced, these amounts may vary. Thus in typical universal laundry detergent tablets, bleach activator contents of between 0.5 and 10% by weight, preferably between 2 and 8% by weight, and in particular between 4 and 6% by weight, are customary, whereas bleach tablets may have consistently higher contents, for example, between 5 and 30% by weight, preferably between 7.5 and 25% by weight, and in particular between 10 and 20% by weight. The skilled worker is not restricted in his or her freedom to formulate and may in this way produce more strongly or more weakly bleaching laundry detergent, cleaning product or bleach tablets by varying the amounts of bleach activator and bleach.

One particularly preferred bleach activator used is N,N,N',N'-tetraacetylethylenediamine, which is widely used in laundry detergents and cleaning products. Accordingly, in preferred laundry detergent and cleaning product tablets, tetraacetylethylenediamine in the abovementioned amounts is used as bleach activator.

In addition to the abovementioned constituents, bleach, bleach activator, builder, surfactant, and disintegration aid, the laundry detergent and cleaning product tablets of the invention may comprise further customary laundry detergent and cleaning product ingredients from the group consisting of dyes, fragrances, optical brighteners, enzymes, foam inhibitors, silicone oils, antiredeposition agents, graying inhibitors, color transfer inhibitors, and corrosion inhibitors.

In order to enhance the esthetic appeal of the laundry detergent and cleaning product tablets of the invention, they may be colored with appropriate dyes. Preferred dyes, whose selection presents no difficulty whatsoever to the skilled worker, possess a high level of storage stability and insensitivity to the other ingredients of the compositions and to light and possess no pronounced affinity for textile fibers, so as not to stain them.

Preference for use in the laundry detergent and cleaning product tablets of the invention is given to all colorants which can be oxidatively destroyed in the wash process, and to mixtures thereof with suitable blue dyes, known as bluing agents. It has proven advantageous to use colorants which are soluble in water or at room temperature in liquid organic substances. Examples of suitable colorants are anionic colorants, e.g., anionic nitroso dyes. One possible colorant is, for example, naphthol green (Colour Index (CI) Part 1: Acid Green 1; Part 2: 10020) which as a commercial product is obtainable, for example, as Basacid® Green 970 from BASF, Ludwigshafen, and also mixtures thereof with suitable blue dyes. Further suitable colorants include Pigmosol® Blue 6900 (CI 74160), Pigmosol® Green 8730 (CI 74260), Basonyl® Red 545 FL (CI 45170), Sandolan® Rhodamin EB400 (CI 45100), Basacid® Yellow 094 (CI 47005), Sicovit® Patent Blue 85 E 131 (CI 42051), Acid Blue 183 (CAS 12217-22-0, CI Acid Blue 183), Pigment Blue 15 (CI 74160), Supranol® Blue GLW (CAS 12219-32-8, CI Acid Blue 221), Nylosan® Yellow N-7GL SGR (CAS 61814-57-1, CI Acid Yellow 218) and/or Sandolan® Blue (CI Acid Blue 182, CAS 12219-26-0).

In the context of the choice of colorant it must be ensured that the colorants do not have too great an affinity for the textile surfaces, and especially for synthetic fibers. At the same time, it should also be borne in mind in choosing appropriate colorants that colorants possess different stabilities with respect to oxidation. The general rule is that water-insoluble colorants are more stable to oxidation than water-soluble colorants. Depending on the solubility and hence also on the oxidation sensitivity, the concentration of the colorant in the laundry detergents and cleaning products varies. With readily water-soluble colorants, e.g., the abovementioned Basacid® Green, or the likewise abovementioned Sandolan® Blue, colorant concentrations chosen are typically in the range from a few $10^{-2}$ to $10^{-3}$% by weight. In the case of the pigment dyes, which are particularly preferred for reason of their brightness but are less readily soluble in water, examples being the abovementioned Pigmosolo dyes, the appropriate concentration of the colorant in laundry detergents or cleaning products, in contrast, is typically from a few $10^{-3}$ to $10^{-4}$% by weight.

The colorants may comprise optical brighteners of the type of the derivatives of diaminostilbenedisulfonic acid and the alkali metal salts thereof. Examples of suitable brighteners are salts of 4,4'-bis(2-anilino-4-morpholino-1,3,5-triazinyl-6-amino)stilbene-2,2'-disulfonic acid or compounds of similar structure which instead of the morphilino group carry a diethanolamino group, a methylamino group, an anilino group, or a 2-methoxyethylamino group. Furthermore, brighteners of the substituted diphenylstyryl type may be present, examples being the alkali metal salts of 4,4'-bis(2-sulfostyryl)biphenyl, 4,4'-bis(4-chloro-3-sulfostyryl)biphenyl, or 4-(4-chlorostyryl)-4'-(2-sulfostyryl) biphenyl. Mixtures of the abovementioned brighteners may also be used. In the laundry detergent and cleaning product tablets of the invention, the optical brighteners are used in concentrations of between 0.01 and 1% by weight, preferably between 0.05 and 0.5% by weight, and in particular between 0.1 and 0.25% by weight, based in each case on the total tablet.

Fragrances are added to the compositions of the invention in order to enhance the esthetic appeal of the products and to provide the consumer with not only product performance but also a visually and sensorially "typical and unmistakeable" product. As perfume oils and/or fragrances it is possible to use individual odorant compounds, examples being the synthetic products of the ester, ether, aldehyde, ketone, alcohol, and hydrocarbon types. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate, and benzyl salicylate. The ethers include, for example, benzyl ethyl ether; the aldehydes include, for example, the linear alkanals having 8–18 carbon atoms, citral, citronellal, citronellyloxyacetaldehyde, cyclamen aldehyde, hydroxycitronellal, lilial and bourgeonal; the ketones include, for example, the ionones, α-isomethylionone and methyl cedryl ketone; the alcohols include anethole, citronellol, eugenol, geraniol, linalool, phenylethyl alcohol, and terpineol; the hydrocarbons include primarily the terpenes such as limonene and pinene. Preference, however, is given to the use of mixtures of different odorants, which together produce an appealing fragrance note. Such perfume oils may also contain natural odorant mixtures, as obtainable from plant sources, examples being pine oil, citrus oil, jasmine oil, patchouli oil, rose oil or ylang-ylang oil. Likewise suitable are clary sage oil, camomile oil, clove oil, balm oil, mint oil, cinnamon leaf oil, lime blossom oil, juniperberry oil, vetiver oil, olibanum oil, galbanum oil and labdanum oil, and also orange blossom oil, neroli oil, orange peel oil, and sandalwood oil.

The fragrance content of the laundry detergent and cleaning product tablets prepared in accordance with the invention is usually up to 2% by weight of the overall formulation. The fragrances may be incorporated directly into the compositions of the invention; alternatively, it may be advantageous to apply the fragrances to carriers which intensify the adhesion of the perfume on the laundry and, by means of slower fragrance release, ensure long-lasting fragrance of the textiles. Materials which have become established as such carriers are, for example, cyclodextrins, it being possible in addition for the cyclodextrin-perfume complexes to be additionally coated with further auxiliaries.

Suitable enzymes include in particular those from the classes of the hydrolases such as the proteases, esterases, lipases or lipolytic enzymes, amylases, cellulases or other glycosyl hydrolases, and mixtures of said enzymes. In the laundry, all of these hydrolases contribute to removing stains, such as proteinaceous, fatty or starchy marks and graying. Cellulases and other glycosyl hydrolases may, furthermore, contribute, by removing pilling and microfibrils, to the retention of color and to an increase in the softness of the textile. For bleaching, and/or for inhibiting color transfer it is also possible to use oxidoreductases. Especially suitable enzymatic active substances are those obtained from bacterial strains or fungi such as *Bacillus subtilis, Bacillus licheniformis, Streptomyces griseus, Coprinus cinereus* and *Humicola insolens*, and also from genetically modified variants thereof. Preference is given to the use of proteases of the subtilisin type, and especially to proteases obtained from *Bacillus lentus*. Of particular interest in this context are enzyme mixtures, examples being those of protease and amylase or protease and lipase or lipolytic enzymes, or protease and cellulase or of cellulase and lipase or lipolytic enzymes or of protease, amylase and lipase or lipolytic enzymes, or protease, lipase or lipolytic enzymes and cellulase, but especially protease and/or lipase-containing mixtures or mixtures with lipolytic enzymes. Examples of such lipolytic enzymes are the known cutinases. Peroxidases or oxidases have also proven suitable in some cases. The suitable amylases include, in particular, alpha-amylases, iso-amylases, pullulanases, and pectinases. Cellulases used are preferably cellobiohydrolases, endoglucanases and endoglucosidases, which are also called cellobiases, and mixtures thereof. Because different types of cellulase differ in their CMCase and Avicelase activities, specific mixtures of the cellulases may be used to establish the desired activities.

The enzymes may be adsorbed on carrier substances or embedded in coating substances in order to protect them against premature decomposition. The proportion of the enzymes, enzyme mixtures or enzyme granules may be, for example, from about 0.1 to 5% by weight, preferably from 0.5 to about 4.5% by weight.

In addition, the laundry detergent and cleaning product tablets may also comprise components which have a positive influence on the ease with which oil and grease are washed off from textiles (these components being known as soil repellents). This effect becomes particularly marked when a textile is soiled that has already been laundered previously a number of times with a detergent of the invention comprising this oil- and fat-dissolving component. The preferred oil- and fat-dissolving components include, for example, nonionic cellulose ethers such as methylcellulose and methylhydroxypropylcellulose having a methoxy group content of from 15 to 30% by weight and a hydroxypropyl group content of from 1 to 15% by weight, based in each case on the nonionic cellulose ether, and also the prior art polymers of phthalic acid and/or terephthalic acid, and/or derivatives thereof, especially polymers of ethylene terephthalates and/or polyethylene glycol terephthalates or anionically and/or nonionically modified derivatives thereof. Of these, particular preference is given to the sulfonated derivatives of phthalic acid polymers and of terephthalic acid polymers.

The tablets of the invention are produced in two steps. In the first step, laundry detergent and cleaning product tablets are produced in a conventional manner by compressing particulate laundry detergent and cleaning product compositions, and in the second step are provided with the coating.

The present invention therefore additionally provides a process for producing coated laundry detergent or cleaning product tablets by conventionally compressing a particulate laundry detergent or cleaning product composition, wherein mechanically sensitive tablet regions are provided following compression with a coating which does not cover the total tablet.

In analogy to the remarks relating to the laundry detergent and cleaning product tablets of the invention, the abovementioned polymers are also preferred in the case of the process of the invention, so that reference may be made to the above remarks.

There follows a description of the two essential process steps.

The tablets later to be coated in accordance with the invention are produced first of all by dry-mixing the constituents, some or all of which may have been pregranulated, and subsequently shaping the dry mixture, in particular by compression to tablets, in which context it is possible to have recourse to conventional processes. To produce the tablets, the premix is compacted in a so-called die between two punches to form a solid compact. This operation, which is referred to below for short as tableting, is divided into four sections: metering, compaction (elastic deformation), plastic deformation, and ejection.

First of all, the premix is introduced into the die, the fill level and thus the weight and form of the resulting tablet being determined by the position of the lower punch and by the form of the compression tool. Even in the case of high tablet throughputs, constant metering is preferably achieved by volumetric metering of the premix. In the subsequent course of tableting, the upper punch contacts the premix and is lowered further in the direction of the lower punch. In the course of this compaction the particles of the premix are pressed closer to one another, with a continual reduction in the void volume within the filling between the punches. When the upper punch reaches a certain position (and thus when a certain pressure is acting on the premix), plastic deformation begins, in which the particles coalesce and the tablet is formed. Depending on the physical properties of the premix, a portion of the premix particles is also crushed and at even higher pressures there is sintering of the premix. With an increasing compression rate, i.e., high throughputs, the phase of elastic deformation becomes shorter and shorter, with the result that the tablets formed may have larger or smaller voids. In the final step of tableting, the finished tablet is ejected from the die by the lower punch and conveyed away by means of downstream transport means. At this point in time, it is only the weight of the tablet which has been ultimately defined, since the compacts may still change their form and size as a result of physical processes (elastic relaxation, crystallographic effects, cooling, etc).

Tableting takes place in commercially customary tableting presses, which may in principle be equipped with single or double punches. In the latter case, pressure is built up not only using the upper punch; the lower punch as well moves toward the upper punch during the compression operation, while the upper punch presses downward. For small production volumes it is preferred to use eccentric tableting presses, in which the punch or punches is or are attached to an eccentric disk, which in turn is mounted on an axle having a defined speed of rotation. The movement of these compression punches is comparable with the way in which a customary four-stroke engine works. Compression can take place with one upper and one lower punch, or else a plurality of punches may be attached to one eccentric disk, the number of die bores being increased correspondingly. The throughputs of eccentric presses vary, depending on model, from several hundred up to a maximum of 3000 tablets per hour.

For greater throughputs, the apparatus chosen comprises rotary tableting presses, in which a relatively large number of dies is arranged in a circle on a so-called die table. Depending on the model, the number of dies varies between 6 and 55, larger dies also being obtainable commercially. Each die on the die table is allocated an upper punch and a lower punch, it being possible again for the compressive pressure to be built up actively by the upper punch or lower punch only or else by both punches. The die table and the punches move around a common, vertical axis, and during rotation the punches, by means of raillike cam tracks, are brought into the positions for filling, compaction, plastic deformation, and ejection. At those sites where considerable raising or lowering of the punches is necessary (filling, compaction, ejection), these cam tracks are assisted by additional low-pressure sections, low tension rails, and discharge tracks. The die is filled by way of a rigid supply means, known as the filling shoe, which is connected to a stock vessel for the premix. The compressive pressure on the premix can be adjusted individually for upper punch and lower punch by way of the compression paths, the buildup of pressure taking place by the rolling movement of the punch shaft heads past displaceable pressure rolls.

In order to increase the throughput, rotary presses may also be provided with two filling shoes, in which case only one half-circle need be traveled to produce one tablet. For the production of two-layer and multilayer tablets, a plurality of filling shoes are arranged in series, and the gently pressed first layer is not ejected before further filling. By means of an appropriate process regime it is possible in this way to produce laminated tablets and inlay tablets as well, having a construction like that of an onion skin, where in the case of the inlay tablet the top face of the core or of the core layers is not covered and therefore remains visible. Rotary tableting presses can also be equipped with single or multiple tools, so that, for example, an outer circle with 50 bores and an inner circle with 35 bores can be used simultaneously for compresssion. The throughputs of modern rotary tableting presses amount to more than a million tablets per hour.

When tableting with rotary presses it has been found advantageous to perform tableting with minimal fluctuations in tablet weight. Fluctuations in tablet hardness can also be reduced in this way. Slight fluctuations in weight can be achieved as follows:

- use of plastic inserts with small thickness tolerances
- low rotor speed
- large filling shoes
- harmonization between the filling shoe wing rotary speed and the speed of the rotor
- filling shoe with constant powder level
- decoupling of filling shoe and powder charge To reduce caking on the punches, all of the antiadhesion coatings known from the art are available. Polymer coatings, plastic inserts or plastic punches are particularly advantageous. Rotating punches have also been found advantageous, in which case, where possible, upper punch and lower punch should be of rotatable configuration. In the case of rotating punches, it is generally possible to do without a plastic insert. In this case the punch surfaces should be electropolished.

It has also been found that long compression times are advantageous. These times can be established using pressure rails, a plurality of pressure rolls, or low rotor speeds. Since the fluctuations in tablet hardness are caused by the fluctuations in the compressive forces, systems should be employed which limit the compressive force. In this case it is possible to use elastic punches, pneumatic compensators, or sprung elements in the force path. In addition, the pressure roll may be of sprung design.

Tableting machines suitable in the context of the present invention are obtainable, for example, from the following companies: Apparatebau Holzwarth GbR, Asperg, Wilhelm Fette GmbH, Schwarzenbek, Hofer GmbH, Weil, Horn & Noack Pharmatechnik GmbH, Worms, IMA Verpackungssysteme GmbH, Viersen, KILIAN, Cologne, KOMAGE, Kell am See, KORSCH Pressen A G, Berlin, and Romaco GmbH, Worms. Examples of further suppliers are Dr. Herbert Pete, Vienna (AU), Mapag Maschinenbau AG, Berne (CH), BWI Manesty, Liverpool (GB), I. Holland Ltd., Nottingham (GB), Courtoy N. V., Halle (BE/LU), and Medicopharm, Kamnik (SI). A particularly suitable apparatus is, for example, the hydraulic double-pressure press HPF 630 from LAEIS, D. Tableting tools are obtainable, for example, from the following companies: Adams Tablettierwerkzeuge, Dresden, Wilhelm Fett GmbH, Schwarzenbek, Klaus Hammer, Solingen, Herber & Söhne GmbH, Hamburg, Hofer GmbH, Weil, Horn & Noack, Pharmatechnik GmbH, Worms, Ritter Pharmatechnik GmbH, Hamburg, Romaco GmbH, Worms, and Notter Werkzeugbau, Tamm. Further suppliers are, for example, Senss A G, Reinach (CH) and Medicopharm, Kamnik (SI).

The tablets can be produced in predetermined three-dimensional forms and predetermined sizes. Suitable three-dimensional forms are virtually any practicable designs—i.e., for example, bar, rod or ingot form, cubes, blocks and corresponding three-dimensional elements having planar side faces, and in particular cylindrical designs with a circular or oval cross section. This latter design covers forms ranging from tablets through to compact cylinders having a height-to-diameter ratio of more than 1.

The portioned compacts may in each case be formed as separate, individual elements corresponding to the predetermined dosage of the laundry detergents and/or cleaning products. It is equally possible, however, to design compacts that combine a plurality of such mass units in one compact, with the ease of separation of smaller, portioned units being provided for in particular by means of predetermined breakage points. For the use of textile laundry detergents in machines of the type customary in Europe, with a horizontally arranged mechanism, it may be judicious to design the portioned compacts as tablets, in cylindrical or block form, preference being given to a diameter/height ratio in the range from about 0.5:2 to 2:0.5. Commercial hydraulic, eccentric or rotary presses are suitable in particular for producing such compacts.

The three-dimensional form of another embodiment of the tablets is adapted in its dimensions to the dispener drawer of commercially customary household washing machines, so that the tablets can be metered without a dosing aid directly into the dispenser drawer, where they dissolve during the initial rinse cycle. Alternatively, it is of course readily possible, and preferred in the context of the present invention, to use the laundry detergent tablets by way of a dosing aid.

Another preferred tablet which can be produced has a platelike or barlike structure with, in alternation, long, thick and short, thin segments, so that individual segments can be broken off from this "slab" at the predetermined breaking points, represented by the short, thin segments, and inserted into the machine. This principle of the "slablike" tablet detergent may also be realized in other geometric forms; for example, vertical triangles connected to one another lengthwise at only one of their sides.

However, it is also possible for the various components not to be compressed to a homogeneous tablet, but instead to obtain tablets having a plurality of layers, i.e., at least two layers. In this case it is also possible for these different layers to have different dissolution rates. This may result in advantageous performance properties for the tablets. If, for example, there are components present in the tablets which have adverse effects on each other, then it is possible to integrate one component into the quicker-dissolving layer and the other component into a slower-dissolving layer, so that the first component has already reacted when the second passes into solution. The layer structure of the tablets may be realized in stack form, in which case dissolution of the inner layer(s) at the edges of the tablet takes place at a point when the outer layers have not yet fully dissolved; alternatively, the inner layer(s) may also be completely enveloped by the respective outerlying layer(s), which prevents premature dissolution of constituents of the inner layer(s).

In one further-preferred embodiment of the invention, a tablet consists of at least three layers, i.e., two outer and at least one inner layer, with at least one of the inner layers comprising a peroxy bleach, while in the stack-form tablet the two outer layers, and in the case of the envelope-form tablet the outermost layers, are free from peroxy bleach. Furthermore, it is also possible to provide spatial separation of peroxy bleach and any bleach activators and/or enzymes present in a tablet. Multilayer tablets of this kind have the advantage that they can be used not only by way of a dispenser drawer or by way of a dosing device which is placed into the washing liquor; instead, in such cases it is also possible to place the tablet into the machine in direct contact with the textiles without fear of spotting by bleaches and the like.

In addition to the layer structure, multiphase tablets may also be produced in the form of ring/core tablets, inlay tablets, or what are known as bulleye tablets. An overview of such embodiments of multiphase tablets is described in EP 055 100 (Jeyes Group). That document discloses toilet cleaning blocks comprising a formed body comprising a slow-dissolving cleaning product composition, into which a bleach tablet has been embedded. The document at the same time discloses a wide variety of design forms of multiphase tablets, ranging the simple multiphase tablet through to complex multilayer systems with inlays.

After compression, the laundry detergent and cleaning product tablets possess high stability. The fracture strength of cylindrical tablets can be gaged by way of the parameter of diametral fracture stress. This diametral fracture stress can be determined by $$\sigma = \frac{2P}{\pi D t}$$

where σ represents the diametral fracture stress (DFS) in Pa, P is the force in N which leads to the pressure exerted on the tablet that causes it to fracture, D is the tablet diameter in meters, and t is the tablet height.

Preferred production processes for laundry detergent tablets start from granules comprising surfactant which are processed with further processing components to form a particulate premix for compression. Entirely in analogy to the above remarks concerning preferred ingredients of the laundry detergent and cleaning product tablets of the invention, the use of further ingredients is also to be transferred to their preparation. In preferred processes, the particulate premix further comprises one or more types of granules comprising surfactant and has a bulk density of at least 500 g/l, preferably at least 600 g/l, and in particular at least 700 g/l.

In preferred processes of the invention, the granules comprising surfactant have particle sizes of between 100 and 2000 μm, preferably between 200 and 1800 μm, with particular preference between 400 and 1600 μm, and in particular between 600 and 1400 μm.

The further ingredients of the laundry detergent and cleaning product tablets of the invention as well may be introduced into the process of the invention, reference being made to the above remarks. Preferred processes are those wherein the particulate premix further comprises one or more substances from the group consisting of bleaches, bleach activators, disintegration aids, enzymes, pH modifiers, fragrances, perfume carriers, fluorescers, dyes, foam inhibitors, silicone oils, antiredeposition agents, optical brighteners, graying inhibitors, color transfer inhibitors, and corrosion inhibitors.

The second step of the process of the invention comprises applying the partial coating. For this purpose it is possible to have recourse to common methods of coating bodies, i.e., in particular, the immersion of parts of the tablet in, or the spraying of these parts with, a melt, solution or dispersion of the abovementioned polymers. Accordingly, in preferred processes of the invention, coating takes place by immersion of mechanically sensitive tablet regions into, or by spraying of these regions with, a melt, solution, emulsion or dispersion of one or more coating materials.

Depending on the materials used for the partial coating, the production process may be varied. For substances which can be melted without decomposition and form stable, sufficiently processible melts, preference is given to the technique of melt coating, since the corresponding coat is formed rapidly and the use of additional auxiliaries such as solvents, etc., is unnecessary. In particular, inorganic salts, organic compounds such as urea or the polyalkylene glycols are preferably applied by the technique of melt coating to the mechanically sensitive tablet regions. Preference is given to processes wherein a melt is applied to the edges of the tablets at temperatures from 40 to 200° C., preferably from 45 to 170° C., and in particular from 50 to 150° C.

Depending on the geometry of the tablets, the melt may be applied by means of appropriately shaped nozzles and by spraying of the melt; however, it is also possible to guide the tablet past brushes, nonwovens or micronozzles which meter the melt onto the desired regions, where it solidifies and forms the partial coating. In addition, appropriately shaped chambers in which the melt is present in predetermined regions which allow contact with the tablet only at certain points, and the insertion in or rolling of the tablets through these chambers, constitute a technique which may be employed.

Substances which are unmeltable or very difficult to melt may be applied as solutions, dispersions or emulsions. These include in particular the abovementioned polymers. Corresponding processes wherein a solution, emulsion or dispersion of one or more coating materials with concentrations of from 1 to 95% by weight, preferably from 5 to 90% by weight, and in particular from 10 to 80% by weight, based in each case on the solution, emulsion or dispersion, is applied to the edges of the tablets are preferred.

Since the immersion of the mechanically sensitive regions of laundry detergent or cleaning product tablets in melts or solutions, or dispersions, leads to the desired partial coatings only with a high level of technical expenditure, it is preferred in the context of the present invention to apply solutions or dispersions to the tablets by spraying, the solvent or dispersion medium evaporating to leave a coating on the corresponding parts of the tablet. In preferred processes of the invention, an aqueous solution of one or more polymers from the abovementioned groups a) to e) is sprayed onto the mechanically sensitive parts of the tablets, said aqueous solution containing, based in each case on the solution, from 1 to 20% by weight, preferably from 2 to 15% by weight, and in particular from 4 to 10% by weight, of polymer(s) from groups a) to e), optionally up to 20% by weight, preferably up to 10% by weight, and in particular less than 5% by weight, of one or more water-miscible solvents, and water as the remainder.

In order to shorten the drying time, further water-miscible solvents of high volatility may be admixed to the aqueous solution. These solvents hail in particular from the group of the alcohols, preference being given to ethanol, n-propanol, and isopropanol. For reasons of cost, ethanol and isopropanol are particularly recommended.

A further preferred embodiment of the process of the invention is a process variant wherein an aqueous dispersion of one or more polyurethanes, additionally comprising one or more dissolved polymers from groups a) to e), is sprayed onto the tablets, said dispersion containing, based in each on the dispersion, from 1 to 20% by weight, preferably from 2 to 15% by weight, and in particular from 4 to 10% by weight, of polyurethane(s), from 1 to 20% by weight, preferably from 2 to 15% by weight and in particular from 4 to 10% by weight, of polymer(s) from groups a) to e), optionally up to 20% by weight, preferably up to 10% by weight, and in particular less than 5% by weight, of one or more water-miscible solvents, and water as the remainder.

Aqueous dispersions in the sense of the invention are those dispersions whose external phase consists predominantly of water. The external phase may further comprise water-miscible solvents such as ethanol and isopropanol, for example; these further solvents are present at most in amounts of up to 20% by weight, based on the overall composition. Preferably, the external phase contains water as sole solvent; a further preferred embodiment contains not more than 5% of other solvents in the external phase, based on the overall composition.

The spray application of such aqueous solutions and dispersions may take place in different ways, which are familiar to the skilled worker. For example, the solution or dispersion may be supplied by means of pump system to a nozzle, where the solution or dispersion is finely atomized by the high shear forces. The resulting spray mist can then be directed onto the tablets to be coated, which thereafter are optionally dried with the aid of appropriate measures (for example, blowing with heated air). An alternative option is to use a multi-substance nozzle and to form mists of the aqueous solutions or dispersions by means of the nozzle with the aid of a stream of gas. In the simplest case, a dual-substance nozzle is used and compressed air is utilized as the carrier gas. In order to protect the dispersion, if appropriate, against oxidation or other interactions with the carrier gas, it is also possible to use other carrier gases such as nitrogen, noble gases, lower alkanes or ethers, for example.

It is likewise possible to reduce the water content of the dispersion or solution, thereby shortening the drying times, minimizing interactions with moisture-sensitive ingredients on the tablet surface, and lowering the production costs. Here again, appropriate solvents are the abovementioned lower alcohols, less preference being given to completely anhydrous solvent mixtures on account of the fact that certain amounts of water favor the formation of a uniform coat. In preferred processes of the invention, a solution or dispersion of one or more polymers from groups a) to e) in a solvent or solvent mixture from the group consisting of water, ethanol, propanol, isopropanol, n-heptane and mixtures thereof is sprayed onto the tablets with the aid of inert propellants from the group consisting of nitrogen, dinitrogen oxide, propane, butane, dimethyl ether, and mixtures thereof.

In the case of such process variants which are preferred in accordance with the invention, the composition of the solutions or dispersions is advantageously as follows, the amounts being based in each case on the dispersion that is to be applied by spraying:

i) from 30 to 99% by weight, in particular from 40 to 90% by weight, and in particular from 50 to 85% by weight, of ethanol, propanol, isopropanol, n-heptane or mixtures thereof, ii) from 0 to 20, preferably from 1 to 15, and in particular from 2 to 10% by weight of water, iii) from 1 to 50, preferably from 2 to 25, and in particular from 3 to 10% by weight of one or more polymers from groups a) to e).

If polyurethanes or other ingredients are to be a constituent of the coating, then they may replace the polymers from groups a) to e) in the abovementioned guideline formulation to the extent of up to 50% of the stated weight.

Examples of other possible ingredients of the dispersions to be sprayed include dyes, fragrances, and pigments. Such additives enhance, for example, the visual or olfactory impression of the tablets coated in accordance with the invention. Dyes and fragrances have been described at length above. Examples of suitable pigments are white pigments such as titanium dioxide or zinc sulfide, pearlescent pigments, or color pigments, the latter being subdivisible into inorganic pigments and organic pigments. All said pigments, if used, are used preferably in finely divided form, i.e., with average particle sizes of 100 $\mu$m and well below.

In order to achieve the formation of a uniform and very thin coating, it is preferred to produce from the solution or dispersion of the coating materials a very fine mist before applying it to the tablet. Processes of the invention wherein the solution and/or dispersion in question is applied to the tablets by way of a nozzle, the average droplet size in the spray mist being less than 100 $\mu$m, preferably less than 50 $\mu$m, and in particular less than 35 $\mu$m, are preferred. In this way, the abovementioned preferred thickness of the coating is easy to realize.

Of course, the comments made above for solutions and dispersions also apply to emulsions.

In processes which are preferred in the context of the present invention, the solution, emulsion or dispersion comprises as solvent, emulsion base or dispersion medium one or more substances from the group consisting of water, methanol, ethanol, 1-propanol, 2-propanol, diethyl ether, n-heptane, and mixtures thereof and is sprayed onto the tablets with the aid of inert propellants from the group consisting of air, nitrogen, dinitrogen oxide, propane, butane, dimethyl ether, and mixtures thereof.

The present invention further provides for the use of coatings which do not cover the entire surface of the tablets for improving the physical properties, especially the abrasion stability and edge stability, of laundry detergent or cleaning product tablets.

This inventive use of a partial coating leads to partially coated tablets having advantageous properties, as shown by the examples below. As regards preferred embodiments of the use in accordance with the invention (ingredients, premix composition, preferred coating materials, etc.), the comments made above for the process of the invention apply analogously.

EXAMPLES

To produce uncoated laundry detergent and cleaning product tablets, surfactant granules were mixed with further processing components and compressed to tablets on an eccentric tableting press. The composition of the surfactant granules is indicated in Table 1 below, the composition of the premix for compression (and thus the composition of the tablets) in Table 2.

TABLE 1

| Surfactant granules [% by weight] | |
|---|---|
| $C_{9-13}$ alkylbenzenesulfonate | 18.4 |
| $C_{12-18}$ fatty alcohol sulfate | 4.9 |
| $C_{12-18}$ fatty alcohol containing 7 EO | 4.9 |
| Soap | 1.6 |
| Sodium carbonate | 18.8 |
| Sodium silicate | 5.5 |
| Zeolite A (anhydrous active substance) | 31.3 |
| Optical brightener | 0.3 |
| Na hydroxyethane-1,1-diphosphonate | 0.8 |
| Acrylic acid-maleic acid copolymer | 5.5 |
| Water, salts | remainder |

TABLE 2

| Premix [% by weight] | |
|---|---|
| Surfactant granules | 62.95 |
| Sodium perborate monohydrate | 17.00 |
| Tetraacetylethylenediamine | 7.30 |
| Foam inhibitor | 3.50 |
| Enzymes | 1.70 |
| Repel-O-Tex ® SRP 4* | 1.10 |
| Perfume | 0.45 |
| Zeolite A | 1.00 |
| Cellulose | 5.00 |

**terephthalic acid ethylene glycol-polyethylene glycol ester (Rhodia, Rhône-Poulenc)

The tabletable premix was compressed in a Korsch eccentric press to give round tablets (diameter: 44 mm, height: 22 mm, weight: 37.5 g).

These tablets were divided into two series; the first series was used untreated as comparative example (V) while the second series (E) was treated with a 97.5/2.5% by weight urea/ethanolamine melt. For this purpose, 0.9 g of melt per tablet was applied to the "cylinder walls", so that the two circular areas of the tablet had a 2 mm wide "outer ring" of coating material. In order to realize a further-preferred embodiment with a little covered surface, an annular adhesive strip (height: 18 mm) may be applied along the outer cylinder surface before the melt is applied, this strip being removed following application of the coating. By this means it is possible to produce tablets which, starting from the edges, have a coating strip of only 2 mm in width, and where, consequently, the outer cylinder surface is not completely covered by the coating.

Two tablets from each of the two series V and E were placed on a sieve having a mesh size of 4 mm and were shaken on a commercial Retsch sieving machine at maximum amplitude for 120 seconds. Following this test, the appearance of the tablet edges was evaluated visually. Evaluation was based on the following scheme:

| | |
|---|---|
| + | no edge fracture |
| 0 | little edge fracture |
| − | severe edge fracture |

The capacity for incorporation by rinsing was tested in a washing machine of type Novotronic W918 (main wash program, 60° C.). Following the rinsing-in cycle with three tablets and cold municipal water (10° C., 160 dH [German hardness]), the residues were dried and weighed.

To determine the disintegration of the tablet, it was placed in a glass beaker with water (600 ml of water, temperature 30° C.) and the time taken for the tablet to disintegrate completely was measured. The experimental data for the individual tablet series are shown in Table 3:

TABLE 3

Laundry detergent tablets [physical data]

| Tablet | E | V |
|---|---|---|
| Edge fracture | – | + |
| Residue [g] | 4 | 3 |
| Disintegration [s] | 14 | 13 |

The results show that the edge stability can be improved markedly just by coating the critical regions, without adversely affecting the disintegration time or ease of incorporation by rinsing.

What is claimed is:

1. A compacted laundry detergent or cleaning product tablet having a surface and comprising:

i) at least one builder; and ii) at least one surfactant, the tablet having a coating and the surface having one or more mechanically sensitive parts, wherein the coating covers only the one or more mechanically sensitive parts and no surface between those portions of two or more mechanically sensitive parts that are more than 10 mm apart.

2. The tablet of claim 1, wherein the coating covers not more than 80 percent of the total surface area of the tablet.

3. The tablet of claim 1, wherein the tablet has at least one corner which is a mechanically sensitive part and the coating covers said at least one corner.

4. The tablet of claim 1, wherein the tablet has at least one edge which is a mechanically sensitive part and the coating covers said at least one edge.

5. The tablet of claim 1, wherein the tablet has at least two edges which are both mechanically sensitive parts, and the coating covers from 1 to 60 percent of the distance between the two edges.

6. The tablet of claim 1, wherein the weight ratio of the uncoated weight of tablet to the weight of the coating is greater than 10:1.

7. The tablet of claim 1, wherein the coating has a thickness of from 0.1 to 3000 $\mu$m.

8. The tablet of claim 1, wherein the coating comprises at least one solid substance having a solubility in water of more than 200 g/l at 20° C.

9. The tablet of claim 1, wherein the coating comprises at least one carboxylic acid.

10. The tablet of claim 1, wherein the coating comprises at least one dicarboxylic acid.

11. The tablet of claim 1, wherein the coating comprises at least one film-forming substance.

12. The tablet of claim 1, wherein the coating comprises 0.1 to 10 percent by weight of at least one disintegration aid.

13. The tablet of claim 1, wherein the coating comprises 0.5 to 10 percent by weight of at least one cellulose-based disintegration aid.

14. The tablet of claim 1, wherein said at least one surfactant is present in an amount of more than 2.5 percent by weight and is selected from the group consisting of anionic surfactants and nonionic surfactants.

15. The tablet of claim 1, wherein the coating comprises at least one of the following polymers:

a) water-soluble nonionic polymers selected from the group consisting of:

a1) polyvinyl pyrrolidones, a2) vinyl pyrrolidone/vinyl ester copolymers, and a3) cellulose ethers;

b) water-soluble amphoteric polymers selected from the group consisting of:

b1) alkyl acrylamide/acrylic acid copolymers, b2) alkyl acrylamide/methacrylic acid copolymers, b3) alkyl acrylamide/methyl methacrylic acid copolymers, b4) alkyl acrylamide/acrylic acid/alkylaminoalkyl (meth)acrylic acid copolymers, b5) alkyl acrylamide/methacrylic acid/alkylaminoalkyl (meth)acrylic acid copolymers, b6) alkyl acrylamide/methyl methacrylic acid/alkylaminoalkyl (meth)-acrylic acid copolymers, b7) alkyl acrylamide/alkyl methacrylate/alkylaminoethyl methacrylate/alkyl methacrylate copolymers, and b8) copolymers of:

b8i) unsaturated carboxylic acids, b8ii) cationically derivatized unsaturated carboxylic acids, and b8iii) optionally other ionic or nonionic monomers;

c) water-soluble zwitterionic polymers selected from the group consisting of:

c1) acrylamidoalkyltrialkylammonium chloride/acrylic acid copolymers and alkali metal and ammonium salts thereof, c2) acrylamidoalkyl trialkylammonium chloride/methacrylic acid copolymers and alkali metal and ammonium salts thereof, and c3) methacroyl ethyl betaine/methacrylate copolymers;

d) water-soluble anionic polymers selected from the group consisting of:

d1) vinyl acetate/crotonic acid copolymers, d2) vinyl pyrrolidone/vinyl acrylate copolymers, d3) acrylic acid/ethyl acrylate/N-tert.butyl acrylamide terpolymers, d4) graft polymers of vinyl esters, esters of acrylic acid or methacrylic acid individually or in admixture copolymerized with crotonic acid, acrylic acid or methacrylic acid with polyalkylene oxides and/or polyalkylene glycols, d5) grafted and crosslinked copolymers from the copolymerization of:

d5i) at least one monomer of the nonionic type, d5ii) at least one monomer of the ionic type, d5iii) polyethylene glycol, and d5iv) a crosslinking agent, d6) copolymers obtained by copolymerization of at least one monomer of each of the following three groups:

d6i) esters of unsaturated alcohols and short-chain saturated carboxylic acids and/or esters of short-chain saturated alcohols and unsaturated carboxylic acids, d6ii) unsaturated carboxylic acids, and d6iii) esters of long-chain carboxylic acids and unsaturated alcohols and/or esters of the carboxylic acids of group d6ii) with saturated or unsaturated, linear or branched $C_8$–$C_{18}$ alcohols, d7) terpolymers of crotonic acid, vinyl acetate and an allyl or methallyl ester, d8) tetrapolymers and pentapolymers of:

d8i) crotonic acid or allyloxyacetic acid, d8ii) vinyl acetate or vinyl propionate, d8iii) branched allyl or methallyl esters, and d8iv) vinyl ethers, vinyl esters or straight-chain allyl or methallyl esters, d9) crotonic acid copolymers with one or more monomers from the group consisting of ethylene, vinyl benzene, vinyl methyl ether, acrylamide and water-soluble salts thereof, and d10) terpolymers of vinyl acetate, crotonic acid and vinyl esters of a saturated aliphatic monocarboxylic acid branched in the α-position; or e) water-soluble cationic polymers selected from the group consisting of:

e1) quaternized cellulose derivatives, e2) polysiloxanes containing quaternary groups, e3) cationic guar derivatives, e4) polymeric dimethyl diallylammonium salts and copolymers there of with esters and amides of acrylic acid and methacrylic acid, e5) copolymers of vinyl pyrrolidone with quaternized derivatives of dialkylaminoacrylate and methacrylate, e6) vinyl pyrrolidone/methoimidazolinium chloride copolymers, e7) quaternized polyvinyl alcohol, and e8) polymers known by the INCI names of polyquaternium 2, polyquaternium 17, polyquaternium 18 and polyquaternium 27.

16. A method of producing a coated laundry detergent or cleaning product tablet according to claim 1, the method comprising the steps of:

a) compressing a p articulate detergent or cleaning product to form a tablet, wherein the tablet has one or more mechanically sensitive parts; and b) covering said one or more mechanically sensitive parts with a coating comprising at least one coating material, wherein the coating does not cover the entire surface area of the tablet.

17. The method of claim 16, wherein covering step b) takes place by spraying said one or more mechanically sensitive parts with a melt, solution, emulsion or dispersion comprising the one or more coating materials.

18. The method of claim 16, wherein covering step b) takes place by immersing said one or more mechanically sensitive parts in a melt, solution, emulsion or dispersion comprising the one or more coating materials.

19. The method of claim 16, wherein the covering step b) takes places by applying a melt to said one or more mechanically sensitive parts, and the melt is at a temperature of from 40 to 100° C.

20. The method of claim 16, wherein the coating is applied with at least one inert propellant selected from the group consisting of air, nitrogen, dinitrogen oxide, propane, butane, and dimethyl ether, further wherein the coating comprises at least one solvent selected from the group consisting of water, methanol, ethanol, 1-propanol, 2-propanol, diethyl ether, and n-heptane.

* * * * *